US005107684A

United States Patent [19]

Nakayama et al.

[11] Patent Number: 5,107,684

[45] Date of Patent: Apr. 28, 1992

[54] AIR CONDITIONER AND OPERATING METHOD THEREOF

[75] Inventors: Susumu Nakayama, Shizuoka; Kensaku Oguni; Sigeaki Kuroda, both of Shimizu; Rumi Minakata; Takao Senshu, both of Shizuoka, all of Japan

[73] Assignee: Hitachi, Ltd., Tokyo, Japan

[21] Appl. No.: 485,049

[22] Filed: Feb. 26, 1990

[30] Foreign Application Priority Data

Feb. 27, 1989 [JP] Japan ..... 1-42980

[51] Int. Cl.[5] ..... F25B 13/00

[52] U.S. Cl. ..... 62/81; 62/160; 62/324.6

[58] Field of Search ..... 62/160, 81, 324.6

[56] References Cited

U.S. PATENT DOCUMENTS 4,771,610 9/1988 Nakashima et al. ..... 62/160
4,862,705 9/1989 Nakamura et al. ..... 62/324.6
4,878,357 11/1989 Sekigami et al. ..... 62/160

FOREIGN PATENT DOCUMENTS 0057346 5/1979 Japan ..... 62/324.6

*Primary Examiner*—William E. Wayner
*Attorney, Agent, or Firm*—Antonelli, Terry, Stout & Kraus

[57] ABSTRACT

An air conditioner comprising a compressor, a four-way directional control valve, an outdoor heat exchanger, and a plurality of indoor heat exchangers, which are arranged to enable the cooling/heating combined operation. The air conditioner further comprises a first connecting pipe bypassed from a piping line, which is adapted to feed a compressed coolant from the compressor toward the outdoor heat exchanger, for line communication with at least one indoor unit, and a second connecting pipe bypassed from a piping line, which is adapted to feed the compressed refrigerant from the compressor toward at least one indoor heat exchanger, for line communication with the outdoor heat exchanger.

2 Claims, 20 Drawing Sheets

AIR CONDITIONER AND OPERATING METHOD THEREOF

BACKGROUND OF THE INVENTION

The present invention relates to an air conditioner having a plurality of indoor units and an operating method of the air conditioner, and, more particularly, to a system for efficiently performing a combined cooling-/heating operation where one indoor unit is operated under the cooling operation, while another indoor unit is operated under the heating operation.

In, for example, Japanese Patent Publication No. 61-45145, for example, a conventional air conditioner is designed for bringing a plurality of indoor units into the cooling or heating operation by selectively changing the direction of flow of refrigerant. In the conventional air conditioner, an inlet piping line of the outdoor unit under the cooling operation can also be coupled to an outlet piping line of at least one indoor unit via a bypass pipe to branch a portion of high-pressure coolant gas for effecting the heating operation of another given indoor unit during the cooling operation. By utilizing the bypass pipe to pass a portion of the liquid refrigerant at an outlet of at least one indoor unit under the heating operation toward another given indoor unit, it is further possible to effect the cooling operation of the given indoor unit during the heating operation.

In the the above-described prior art, construction the indoor unit operated in a reverse mode, e.g., the indoor unit brought into the heating operation when air-cooling is operating under operation as a main mode, is coupled to the outdoor unit in parallel during the cooling/heating combined operation. Therefore, the refrigerant from a compressor is not properly distributed and tends to flow into the outdoor unit, in a larger amount so that the indoor unit operated under a reverse mode is supplied with the refrigerant at a reduced flow rate. This may lead to performance reduction of the unit and hence a reduction in air-conditioning.

SUMMARY OF THE INVENTION

An object of the present invention is to provide an air conditioner and an operating method of the air conditioner with which the indoor unit, operated under a reverse mode, is ensured of a supply refrigerant at a sufficient flow rate for preventing a reduction in performance of the unit.

Another object of the present invention is to permit desired control in flow rates of the refrigerant distributed to all the indoor units for ensuring comfortable air-conditioning.

Still another object of the present invention is to reduce the number of times that a four-way directional control valve is switched or shifted during the cooling-/heating combined operation.

To achieve the above objects, in accordance with the present invention, an air conditioner is provided in which a compressor, an outdoor heat exchanger, and a plurality of indoor heat exchangers connected in parallel and are coupled with each other, with the air conditioner comprising a plurality of flow rate adjusting solenoid valves provided in parallel in piping lines between said compressor and said outdoor heat exchanger Epansion valves are respectively provided in association with the plurality of indoor heat exchangers on the leading to said outdoor heat exchanger. An opening/-closing valve is provided in association with at least one of the indoor heat exchangers on the side leading to the compressor and a connecting pipe, having an opening/-closing valve and connects a joint between the opening/closing valve and the at least one indoor unit to a joint between the compressor and the flow rate adjusting solenoid valves. A check valve is provided in parallel to the expansion valve, which is provided in association with the indoor heat exchanger connected to the connecting pipe, for allowing refrigerant to flow only toward the expansion valves for the remaining one or more indoor heat exchangers.

In accordance with further features of the present invention, an air conditioner is provided comprising an opening adjuster valve provided in association with the outdoor heat exchanger on the side leading to the indoor heat exchangers and serving as an expansion valve, with opening adjuster valves, being respectively provided in association with said indoor heat exchangers on the the leading to the outdoor heat exchanger and serving as expansion valves. First opening/closing valves are respectively provided in association with the indoor heat exchangers on the side leading to the inlet side of said compressor. A three-way directional control valve is provided midway of piping line for connecting the outdoor heat exchanger and the outlet the of the compressor, with a piping line being provided for connecting the remaining one end of said three-way directional control valve. Piping lines respectively connect a joint between the outlet the of said compressor and the three-way directional control valve to joints between the indoor heat exchangers and the first opening/closing valves. Second opening/closing valves are respectively provided in said latter piping lines on the sides leading to the indoor heat exchangers.

In accordance with still further features of the present invention, an air conditioner is provided comprising a first opening adjuster valve provided in association with the outdoor heat exchanger on the the leading to the indoor heat exchangers and serving as an expansion valve, with second opening adjuster valves being respectively provided in association with said indoor heat exchangers on the side leading to said outdoor heat exchanger and serving as expansion valves. First opening/closing valves are respectively provided in association with the indoor heat exchangers on the the leading to the compressor, with a piping line respectively connecting a joint between the outdoor heat exchanger and said indoor heat exchangers to joints between indoor heat exchangers and said first opening/closing valves. Second opening/closing valves are respectively provided in piping lines on the sides leading to said indoor heat exchangers.

In accordance with yet further features of the present invention, an air conditioner is provided in which a compressor, a four-way directional control valve, an outdoor heat exchanger, and a plurality of indoor heat exchangers, connected in parallel, are coupled with each other, with the air conditioner comprising a first opening adjuster valve capable of adjusting a flow rate, provided in association with the outdoor heat exchanger on the side leading to the indoor heat exchangers and serving as an expansion valve. Second opening adjuster valves, capable of adjusting flow rates, are respectively provided in association with the indoor heat exchangers on the side leading to the outdoor heat exchanger and serving as expansion valves. Piping lines respectively connect the indoor heat exchangers and said four-way directional control valve via first opening/closing valves, and connecting pipes respectively connect joints between the indoor heat exchangers and the first opening/closing valves to the inlet side of the compressor via second opening/closing valves.

In accordance with further features of the present invention, an air conditioner is provided in which a compressor, a four-way directional control valve, an outdoor heat exchanger, and a plurality of indoor heat exchangers, connected in parallel, are coupled with each other, with the air conditioner comprising a first piping line for connecting the four-way directional control valve and the outdoor heat exchanger and having a third opening/closing valve; a second piping line for the outdoor heat exchanger and the indoor heat exchangers, an opening adjuster mechanism being provided in second piping line on the side leading to said outdoor heat exchanger and functioning as an expansion valve. Opening adjuster valves are respectively provided in branches of said second line on the side leading to said indoor heat exchangers and serving as expansion valves, with third piping lines respectively connecting said indoor heat exchangers and the four-way directional control valve. A first opening/closing valve is provided in at least one of third piping lines connected to said indoor heat exchangers, with a first connecting pipe connecting the piping line between the first opening/closing valve and the associated indoor heat exchanger to the inlet side of the compressor via a second opening/closing valve. A second connecting pipe is provided with a fourth opening/closing valve and connects the first piping line between the third opening/closing valve and the outdoor heat exchanger to the third piping line between the first opening/closing valve and said four-way directional control valve.

According to the present invention, an air conditioner may be provided in which a compressor, a four-way directional control valve, an outdoor heat exchanger, and a plurality of indoor heat exchangers connected in parallel, are coupled with each other, with the air conditioner comprising a first piping line for connecting the four-way directional control valve and the outdoor heat exchanger and having a third opening/closing valve. A second piping line for connects the outdoor heat exchanger and the indoor heat exchangers, with an opening adjuster mechanism being provided in the second piping line on the side leading to the outdoor heat exchanger and functioning as an expansion valve. Opening adjuster valves at respectively provided in branches of the second line on the side leading to the indoor heat exchangers and serve as expansion valves with third piping lines respectively connecting the indoor heat exchangers and the four-way directional control valve. First opening/closing valves are respectively provided in the third piping lines connected to the indoor heat exchangers, with first connecting pipes respectively connecting the piping lines between the first opening/closing valves and the indoor heat exchangers to the piping line between four-way directional control valve and third opening/closing valve via second opening/closing valves. A second connecting pipe is provided with a fourth opening/closing valve and connects the first piping line between the third opening/closing valve and the outdoor heat exchanger to the third piping lines between the first opening/closing valves and the four-way directional control valve.

The method of the present invention comprises the steps of preparing an outdoor heat exchanger and a plurality of indoor heat exchangers; condensing a portion of compressed refrigerant in the outdoor heat exchanger and then expanding the condensed refrigerant; introducing the remaining compressed refrigerant to a part of said plural indoor heat exchangers for heating the associated indoor air, while condensing the refrigerant, and then expanding the condensed refrigerant; introducing both the expanded refrigerant from the outdoor heat exchanger and the expanded refrigerant from the part of the indoor heat exchangers to the remaining one or more indoor heat exchangers to be run under the cooling operation; and determining the ratio between an amount of the compressed refrigerant introduced to the part of the indoor heat exchangers under the heating operation and an amount of the compressed refrigerant introduced to the remaining indoor heat exchanger under the cooling operation dependent on the ratio between the magnitude of heating load of the part of the indoor heat exchangers under the heating operation and the magnitude of cooling load of the remaining indoor heat exchangers under the cooling operation.

In accordance with further features of the present invention, a method of operating an air conditioner comprises the steps of preparing a compressor, an outdoor heat exchanger and a plurality of indoor heat exchangers; introducing all of compressed refrigerant to a part of the plural indoor heat exchangers for heating the associated indoor air, while condensing the refrigerant, and then expanding the condensed refrigerant; introducing a part of the condensed refrigerant to the remaining one or more indoor heat exchangers to be run under the cooling operation for cooling the indoor air, while evaporating the refrigerant, and then introducing the evaporated refrigerant to the compressor; and introducing the remaining part of the condensed refrigerant to the outdoor heat exchanger for evaporation, and then introducing the evaporated refrigerant to said compressor.

According to the present invention, in the case of the operation in a reverse mode, by restricting the flow rate adjusting valve provided in a flow line of the refrigerant for the outdoor heat exchanger, the refrigerant is caused to flow into the indoor heat exchanger operated in a reverse mode for ensuring a sufficient flow rate of the refrigerant thereby preventing a performance reduction the capability during the operation in a reverse mode.

In the case where the connecting pipe is provided to the indoor heat exchanger operated in a reverse mode to the outdoor heat exchanger in series, the indoor heat exchanger(s) under the cooling operation and the outdoor heat exchanger(s) under the heating operation can be connected in series by fully closing the flow rate adjusting valve, whereby the refrigerant is caused to flow into each group of the indoor heat exchanger(s) under the heating or cooling operation at the same flow rate as passing through the outdoor heat exchanger. This is effective in preventing deficiency of the air-conditioning capability.

Furthermore, by providing the second connecting pipe, the indoor heat exchangers can each be collectively operated in any one of heating and cooling modes without shifting the four-way directional control valve which is kept in the position for a heating or cooling mode. This permits a reduction in the number of times that the four-way directional control valve is shifted.

Other features, objects and advantages of the present invention will be apparent from the following description when taken in connection with the attached drawings.

DESCRIPTION OF PREFERRED EMBODIMENTS

Figure 1:
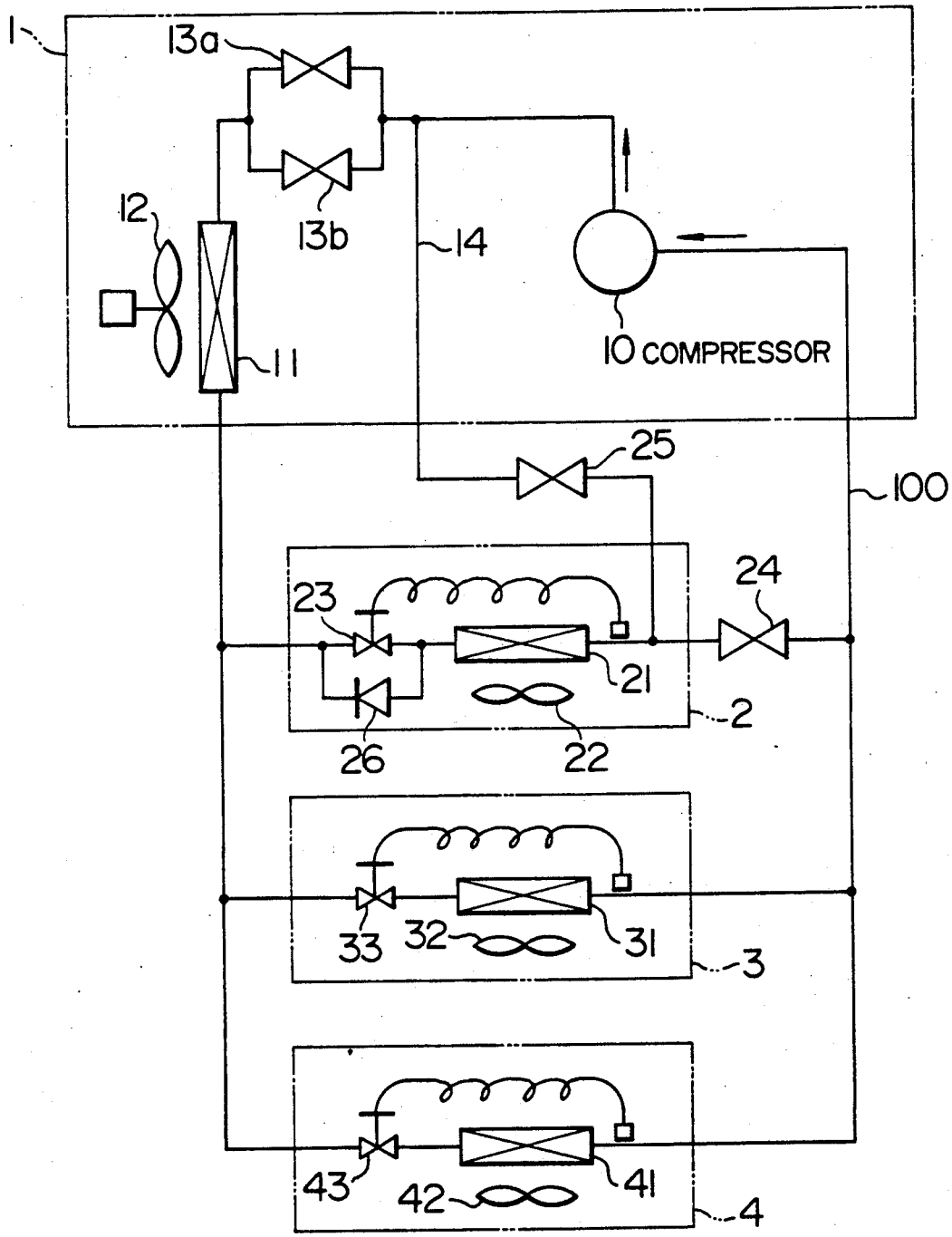
FIG. 1 is a schematic view of refrigerating cycle showing one embodiment of the present invention.

Referring now to the drawings wherein like reference numerals are used throughout the various views to designate like parts and, more particularly, to FIG. 1, according to this figure, an outdoor unit 1 houses therein a compressor 10, an outdoor heat exchanger 11, a fan 12, and a pair of solenoid valves 13*a*, 13*b* provided in parallel for adjusting a flow rate. Indoor units 2, 3, 4 house therein expansion valves 23, 33, 43 as pressure reducing mechanisms, indoor heat exchangers 21, 31, 41, and fans 22, 32, 42, respectively. The expansion valves 23, 33, 43 are each of an expansion valve of the electrically controlled type capable of adjusting a flow rate. An outlet of the compressor 10 is coupled by a piping line to one end of the outdoor heat exchanger 11 via the solenoid valves 13*a*, 13*b*. The other end of the outdoor heat exchanger 11 is connected by a piping line to the expansion valves 23, 33, 43 of the three indoor units 2, 3, 4. In these indoor units 2, 3, 4, the expansion valves 23, 33, 43 are coupled to one ends of the indoor heat exchangers 21, 31, 41, respectively. The other ends of the three indoor heat exchangers 21, 31, 41 are connected by a piping line 100 to an inlet of the compressor 10. Further, between the indoor heat exchanger 21 of the indoor unit 2 and the compressor 10, a solenoid-operated opening/closing valve 24 is attached in a piping line associated with the indoor heat exchanger 21. The piping line between the indoor heat exchanger 21 and the opening/closing valve 24 is coupled by a connecting pipe 14 to the piping line between the compressor 10 and the solenoid valves 13*a*, 13*b* in the outdoor unit 1 via a solenoid-operated opening/closing valve 25. In addition, the expansion valve 23 in the indoor unit 2 is provided with a check valve 26 allowing refrigerant to flow only in the direction from the indoor heat exchanger 21 toward the expansion valves 33, 43 of the other indoor units 3, 4.

When operating all the indoor units 2, 3, 4 under a cooling mode, the opening/closing valve 24 is opened and the opening/closing valve 25 is closed. High-pressure refrigerant gas delivered from the compressor 10 flows into the outdoor heat exchanger 11 via the solenoid valves 13*a*, 13*b* where the gas is condensed to liquid refrigerant through heat exchange with the outdoor air. The liquid refrigerant then flows directly into each of the indoor units 2, 3, 4. In the indoor units 2, 3, 4, the liquid refrigerant is reduced in pressure by the expansion valves 23, 33, 43 such that the degree of super-heat at outlets of the indoor heat exchangers 21, 31, 41 becomes equal to a setting value. The refrigerant thus reduced in pressure is subjected to heat exchange with the indoor air in the respective indoor heat exchangers 21, 31, 41 for cooling the indoor air. After the heat exchange, the refrigerant is turned to low-pressure refrigerant gas having a predetermined degree of superheat, and sucked into the compressor 10. The refrigerant gas suctioned into the compressor 10 is compressed again to the high-pressure refrigerant gas which is delivered from the compressor 10.

With the indoor unit 2 in a heating operation during the cooling operation of the indoor units 3, 4, the opening/closing valve 24 is closed and the opening/closing valve 25 is opened. The high-pressure refrigerant gas, delivered from the compressor 10, flows into both of the outdoor heat exchanger 11 and the indoor heat exchanger 21 of the indoor unit 2 via the connecting pipe 14. The high-pressure refrigerant gas is condensed to the liquid refrigerant through heat exchange with outdoor air in the outdoor heat exchanger 11 and the indoor heat exchanger 21. Then, the liquid refrigerant in the outdoor heat exchanger 11 flows into the indoor units 3, 4, and the liquid refrigerant in the indoor heat exchanger 21 passes through the check valve 26 for joining with the liquid refrigerant from the outdoor heat exchanger 11, followed by flowing also into the indoor units 3, 4. The indoor units 3, 4 operate in the same manner as that in the above case of the cooling operation, and return the low-pressure refrigerant gas to the compressor 10. During this operation, the solenoid valves 13*a*, 13*b* of the outdoor unit 1 are opened and closed such that the temperature of intake to the indoor unit 2 under the heating operation becomes equal to a setting value. A sensor (not shown) is provided for detecting the temperature of intake to the indoor unit 2.

Figure 2:
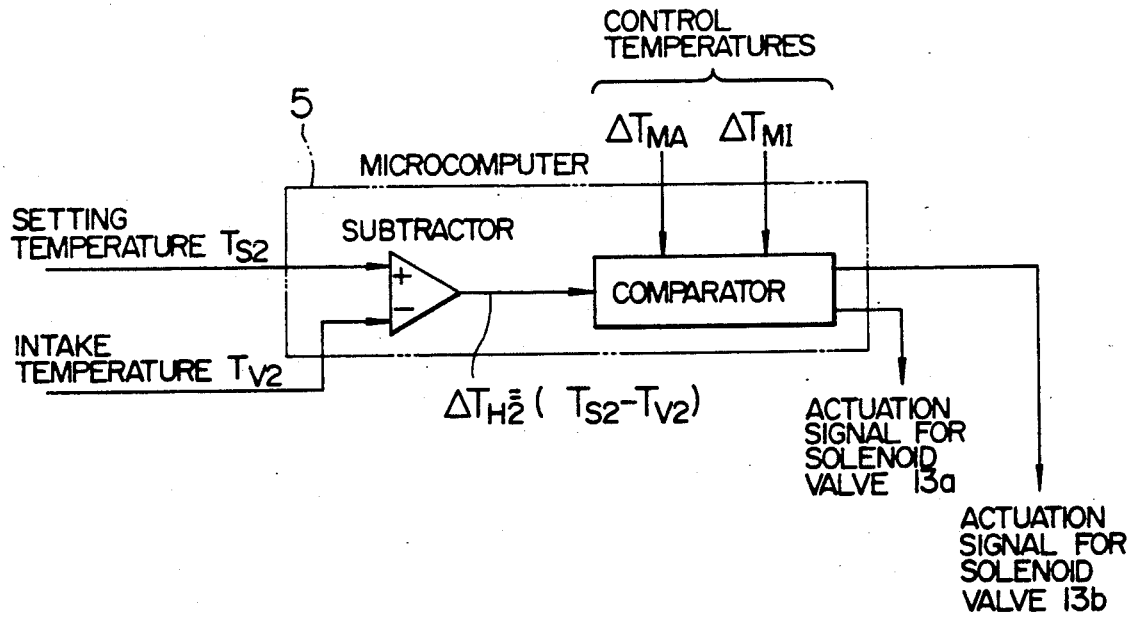
FIG. 2 is a diagrammatic view of a control device in the embodiment of FIG. 1.

In FIG. 2, a microcomputer 5 receives, as inputs thereto, a setting temperature $T_{S2}$ for the room where the indoor unit 2 is installed and a temperature $T_{V2}$ of intake to the indoor unit 2. These two temperatures are processed in the microcomputer 5 such that the temperature $T_{V2}$ is subtracted from the temperature $T_{S2}$ to produce a temperature differential signal $\Delta T_{H2}=(T_{S2}-T_{V2})$ which is the applied to a comparator in the microcomputer 5. On the other hand, $\Delta T_{MA}$ and $\Delta T_{MI}$, as control temperatures, are applied in advance to the comparator in the microcomputer 5. The control temperature $\Delta T_{MA}$ has a value larger than $\Delta T_{MI}$. As shown in Table 1 below, the comparator outputs actuation signals to close both the solenoid valves 13*a*, 13*b* when the temperature difference signal $\Delta T_{H2}$ is larger than the control temperature $\Delta T_{MA}$, whereby all the high-pressure refrigerant gas is passed to the indoor unit 2 for maximizing the heating capability.

TABLE 1

| Conditions | Actuation Signals: Solenoid Valve 13a | Solenoid Valve 13b |
|---|---|---|
| $\Delta T_{H2} > \Delta T_{MA}$ | Close | Close |
| $\Delta T_{MA} \geqq \Delta T_{H2} > \Delta T_{MI}$ | Open | Open |
| $\Delta T_{MI} \geqq \Delta T_{H2} > 0$ | Open | Open |

$(\Delta T_{MA} > \Delta T_{MI})$

When the temperature differential signal $\Delta T_{H2}$ has a value between the two control temperatures $\Delta T_{MA}$ and $\Delta T_{MI}$, the solenoid valve 13a is opened and the solenoid vale 13b is closed to pass a small amount of the high-pressure refrigerant gas to the outdoor unit 1, whereby the flow rate of the high-pressure refrigerant gas supplied to the indoor unit 2 is reduced correspondingly for lowing the heating capability to some extent. When the temperature differential signal $\Delta T_{H2}$ has a value smaller than the control temperature $\Delta T_{MI}$, the solenoid valves 13a, 13b are both opened to pass an increased amount of the high-pressure refrigerant gas to the outdoor unit 1, whereby the flow rate of the high-pressure refrigerant gas supplied to the indoor unit 2 is correspondingly reduced for further lowering the heating capability. When the temperature differential signal $\Delta T_{H2}$ is equal to 0, the opening/closing valve 25 is closed to prevent the high-pressure refrigerant gas from flowing into the indoor unit 2, thereby stopping the heating operation. When the temperature differential signal $\Delta T_{H2}$ is negative, the opening/closing valve 25 is closed and the opening/closing valve 24 is opened to bring the indoor unit 2 into the cooling operation, because the room temeprature is too high. With the above control procedure, the temperature in the room where the indoor unit 2 is installed can be adjusted to any desired value for achievement of comfortable air-conditioning. Also, even during the cooling operation, only a part of the indoor units can be run under the heating operation, and this results in the following advantageous effects. More specifically, the compressor 10 is merely required to be operated with the capability sufficient for the flow rate of the refrigerant passing through the two indoor units 3, 4 under the cooling operation, with the result being that the input load to the compressor can be correspondingly reduced. Further, since the indoor heat exchanger 21 can double as a condenser, the capability of the outdoor heat exchanger 11, necessary as a condenser, can also be reduced. It is thus possible to reduce the rotational speed of the fan 12 and hence lower the input load to the fan 12. At this time, the refrigerant flows through the indoor units 2, 3, 4 at a predetermined flow rate, whereby their capabilities remain unchanged. Accordingly, the entire efficiency is increased corresponding to a decrease in the input load.

Figure 3:
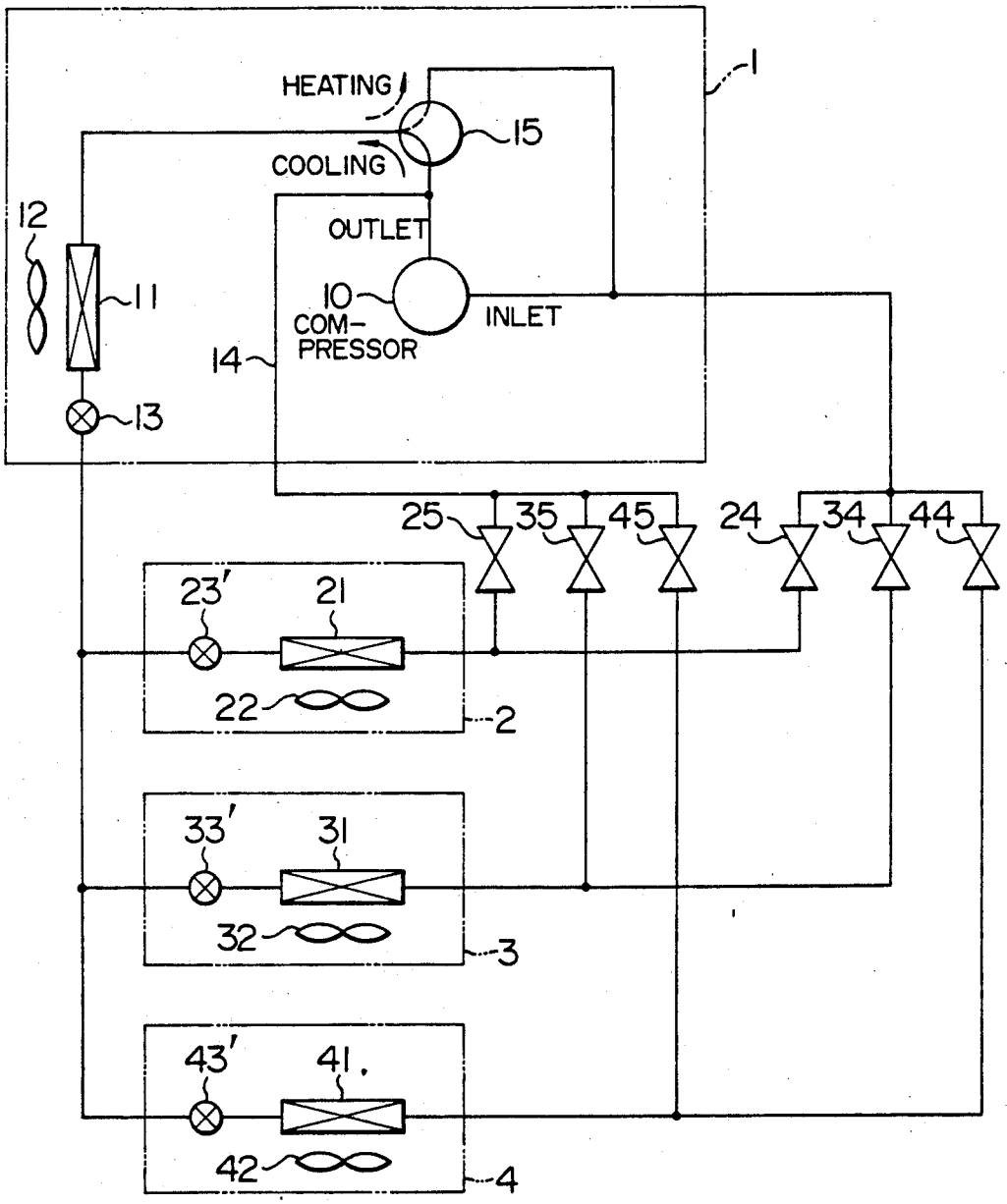
FIG. 3 is a schematic view of a refrigerating cycle showing a second embodiment of the present invention.

As shown in FIG. 3, an outdoor unit 1 houses therein a compressor 10, a three-way directional control valve 15, an outdoor heat exchanger 11, a fan 12, and an adjuster valve 13 serving as an expansion valve. Indoor units 2, 3, 4 house therein adjuster valves 23', 33', 43' serving as expansion valves, indoor heat exchangers 21, 31, 41, and fans 22, 32, 42, respectively. The three-way directional control valve 15 in the outdoor unit 1 is operated to connect an outlet of the compressor 10 and one end of the outdoor heat exchanger 11 during the cooling operation, and to connect an inlet of the compressor 10 and the one end of the outdoor heat exchanger 11 during the heating operation. The other end of the outdoor heat exchanger 11 and the adjuster valve 13, as well as the adjuster valve 13 and the adjuster valves 23', 33', 43' of the three indoor units 2, 3, 4 are coupled to each other by a piping line. In the indoor units 2, 3, 4, the adjuster valves 23', 33', 43' are respectively coupled to one end of the indoor heat exchangers 21, 31, 41 by respective piping lines. The other end of the respective indoor heat exchangers 21, 31, 41 are coupled to the inlet of the compressor 10 by respective piping lines, and solenoid-operated opening/closing valves 24, 34, 44 (first opening/closing valves) are attached midway of the respective piping lines extending from the indoor heat exchangers 21, 31, 41. Furthermore, piping lines between the three indoor heat exchangers 21, 31, 41 and the opening/closing valves 24, 34, 44 are coupled by a connecting pipe 14 to the piping line between the outlet of the compressor 10 and the three-way directional control valve 15, with solenoid-operated opening/closing valves 25, 35, 45 (second opening/closing valves) provided in the connecting pipe 14.

Figure 4:
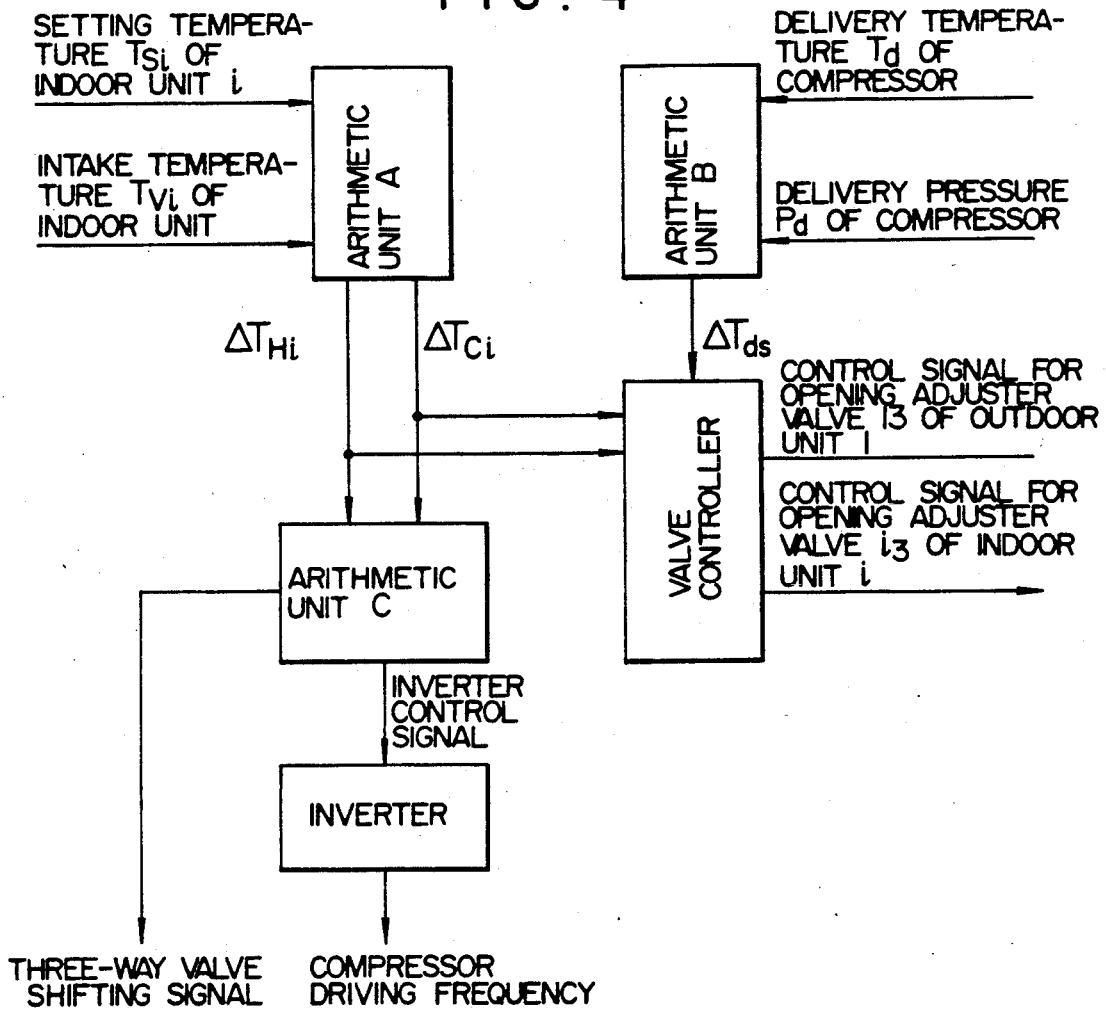
FIG. 4 is a diagrammatic view of a control device in the embodiment of FIG. 3.

In FIG. 4, the temperature $T_{Vi}$ (where the suffix i represents the number of the indoor unit; i=2, 3, 4) of intake to each indoor unit i is detected by a sensor (not shown) and input to an arithmetic unit A along with the setting temperature $T_{Si}$ of air in each room. Also, the delivery pressure $P_d$ and the delivery temperature $T_d$ of the compressor are detected by sensors and input to an arithmetic unit B. The arithmetic unit A determines a difference between the setting temperature $T_{Si}$ and the intake temperature $T_{Vi}$. For the indoor unit under the cooling operation, the temperature differential $\Delta T_{Ci}=(-T_{Vi}-T_{Si})$ is calculated. For the indoor unit under the heating operation, the temperature differential $\Delta T_{Hi}$ is calculated. Also, from the delivery pressure $P_d$, the arithmetic unit B determines a saturation temperature $T_{dS}$ for calculating a degree of superheat $\Delta T_{dS}=(T_d-t_{dS})$ of the delivered gas. The temperature differential $\Delta T_{Ci}$, $\Delta T_{Hi}$ and the degree of superheat $\Delta T_{dS}$ are applied to a valve controller which outputs control signals for the adjuster valves 13 and (23', 33', 43'). An example of the manner of controlling the adjuster valves 13, 13' is shown in FIG. 6.

The temperature differential $\Delta T_{Ci}$, $\Delta T_{Hi}$ are also input to an arithmetic unit C. Using these temperature differential and capacities of the indoor units or dimensions of the rooms, the arithmetic unit C calculates the total cooling load $Q_C$ for the room(s) under the cooling operation and the total heating load $Q_H$ for the room(s) under the heating operation. The maximum load $Q_{max}$ is then determined below using an input load EW to the compressor in accordance with the following relationships:

$$Q_{max}=Q_H \text{ when } Q_H \geqq Q_C+EW$$

$$Q_{max}=Q_C \text{ when } Q_H<Q_C+EW.$$

Figure 5:
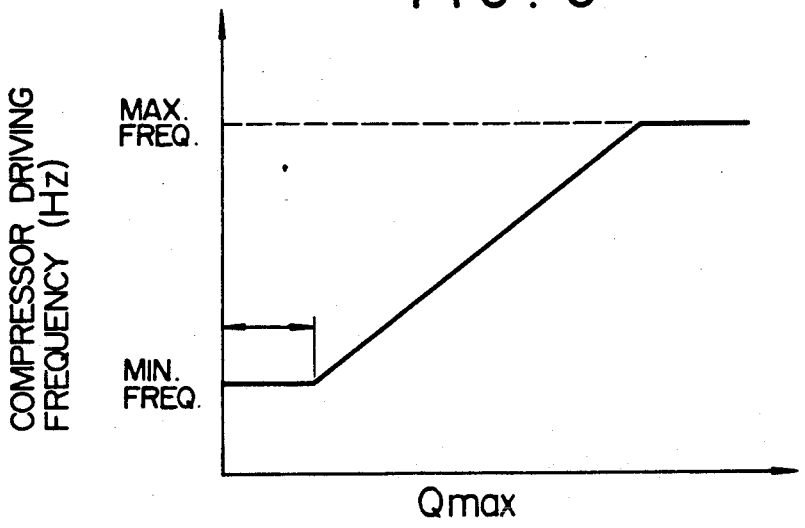
FIGS. 5 and 6A to 6D are graphs for explaining control of the embodiment of FIG. 3.

By utilization of the maximum load $Q_{max}$, the arithmetic unit C performs capacity control for the compressor dependent on the magnitude of $Q_{max}$. The capacity control for the compressor is implemented while changing a rotational speed of the compressor by an inverter, with one example of this control being shown in FIG. 5. When the maximum load $Q_{max}$ is large, the compressor driving frequency is raised to increase an amount of the circulated refrigerant. When the maximum load $Q_{max}$ is small, the compressor driving frequency is lowered to reduce an amount of the circulated coolant. When the maximum load $Q_{max}$ is very so small as to fall below the minimum compressor driving frequency, the compressor is operated under on/off control. Furthermore, the arithmetic unit C outputs a control signal to shift the three-way directional control valve into the position for a heating mode when $Q_{max}=Q_H$ ($Q_H \geqq Q_C+EW$), and into the position for a cooling mode when $Q_{max}=Q_C$ ($Q_H<Q_C+EW$).

Figure 6A:
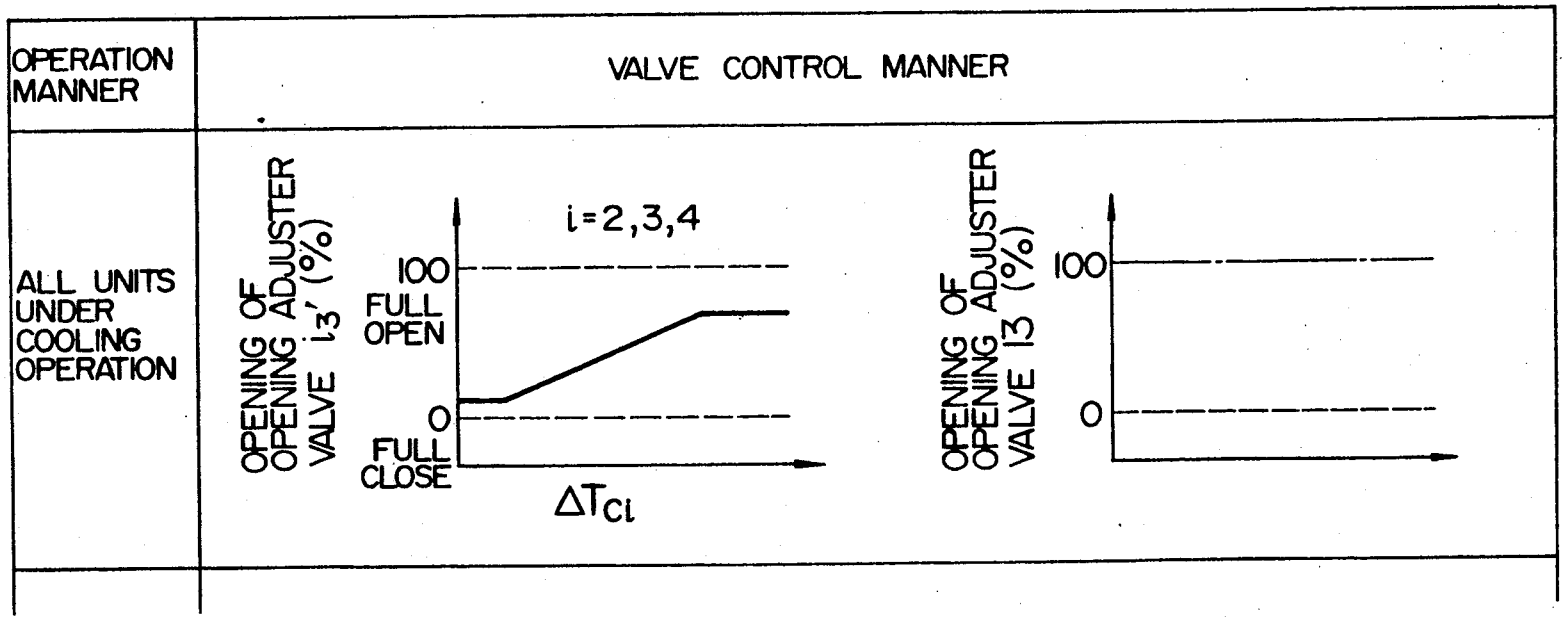

When running all the indoor units 2, 3, 4 under the cooling operation, the three-way directional control valve 15 in FIG. 3 is shifted to connect the outlet of the compressor 10 and the outdoor heat exchanger 11. Then, the solenoid valves 24, 34, 44 are opened and the solenoid valves 25, 35, 45 are closed. The adjuster valve 13 of the outdoor unit 1 and the adjuster valves 23', 33', 43' of the indoor units 2, 3, 4 are controlled as shown in FIG. 6A. Specifically, the adjuster valve 13 of the outdoor unit 1 is fully opened, while the adjuster valves 23', 33', 43' of the indoor units 2, 3, 4 are each regulated in dependence upon the temperature differential $\Delta T_{Ci}$ in the respective room. For the indoor unit having the large temperature differential $\Delta T_{Ci}$, the opening of the adjuster valve 13' is increased to increase a flow rate of the refrigerant for stepping up the cooling capability. For the indoor unit having the small temperature differential $\Delta T_{Ci}$, the adjuster valve 13' is made smaller in its opening to reduce a flow rate of the coolant for stepping down the cooling capability.

With the above control, the high-pressure refrigerant gas delivered from the compressor 10 is condensed to a liquid refrigerant in the outdoor heat exchanger 11 through heat exchange with the outdoor air. The liquid refrigerant then flows directly into each of the indoor units 2, 3, 4 where it is reduced in pressure by the opening adjuster valves 23', 33', 43' and distributed to the indoor heat exchangers 21, 31, 41 at flow rates to match with the respective indoor loads. The refrigerant, reduced in pressure, is subjected to heat exchange with the indoor air in the respective indoor heat exchangers 21, 31, 41 for cooling the indoor air. After the heat exchange, the refrigerant is suctioned into the compressor 10 and compressed again to the high-pressure refrigerant gas which is delivered from the compressor 10.

Figure 6B:
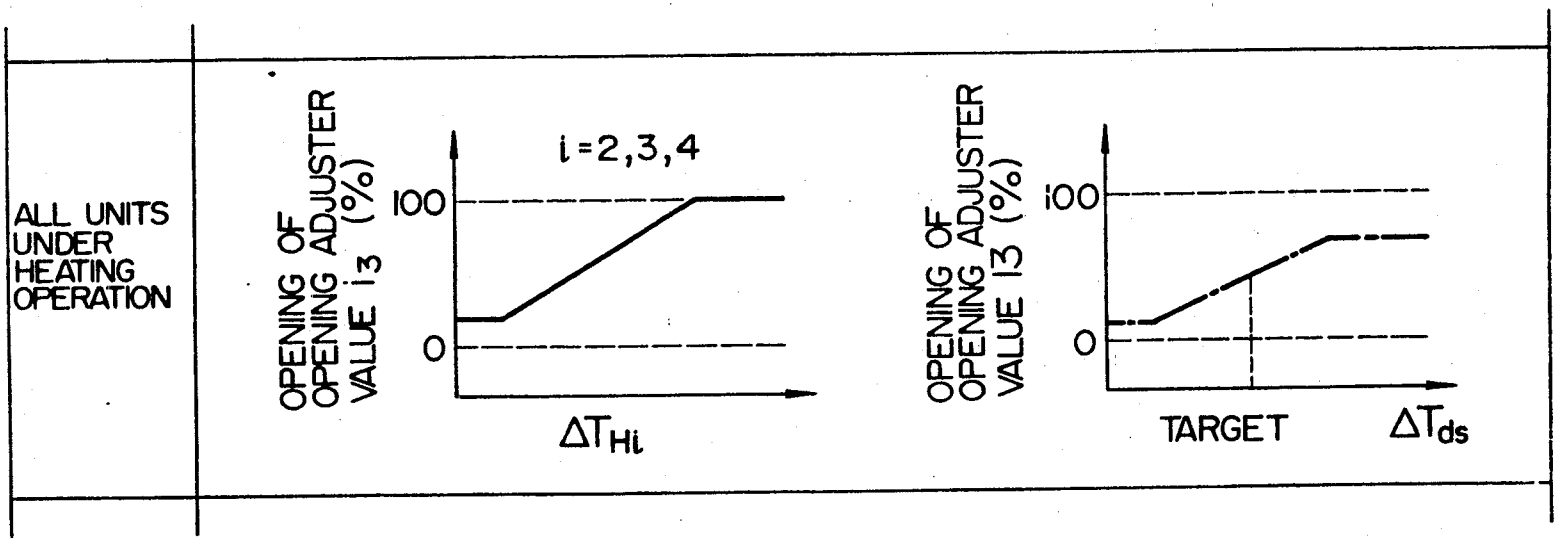

When running all the indoor units 2, 3, 4 under the heating operation, the three-way directional control valve 15 is shifted to connect the inlet of the compressor 10 and the outdoor heat exchanger 11. Then, the first opening/closing valves 24, 34, 44 are closed and the second opening/closing valves 25, 35, 45 are opened. The adjuster valve 13 of the outdoor unit 1 and the adjuster valves 23', 33', 43' of the indoor units 2, 3, 4 are controlled as shown in FIG. 6B. Specifically, the opening of the adjuster valve 13 of the outdoor unit 1 is increased when the degree of superheat $\Delta T_{dS}$ of the delivered gas is large, thereby lowering a degree of pressure reduction to reduce the degree of superheat $\Delta T_{dS}$. When the degree of superheat $\Delta T_{dS}$ is small, the of the adjuster valve 13 is reduced to raise a degree of pressure reduction for increasing the degree of superheat $\Delta T_{dS}$. In this way, the adjuster valve 13 provides a controlling function such that the degree of superheat $\Delta T_{dS}$ of the delivered gas becomes a target value. The adjuster valves 23', 33', 43' of the indoor units 2, 3, 4 are each regulated in dependence upon the temperature differential $\Delta T_{Hi}$ in the respective room. When the temperature differential $\Delta T_{Hi}$ is large, the opening of the adjuster valve 13' is increased to increase a flow rate of the refrigerant for stepping up the heating capability. When the temperature differential $\Delta T_{Hi}$ is small, the opening of the adjuster valve 13' is reduced to reduce a flow rate of the refrigerant for stepping down the heating capability.

Thus, the adjuster valves 23', 33', 43' of the indoor units 2, 3, 4 function as flow rate adjusting valves so that the refrigerant is passed to the indoor units 2, 3, 4 at flow rates matching the respective indoor heating loads for heating the rooms. The refrigerant is turned to a liquid through the indoor units 2, 3, 4 and flows into the outdoor unit 1. After being reduced in pressure by the adjuster valve 13, the refrigerant enters the outdoor heat exchanger 11 for heat exchange with the outdoor air, followed by being suctioned into the compressor 10.

Figure 6C:
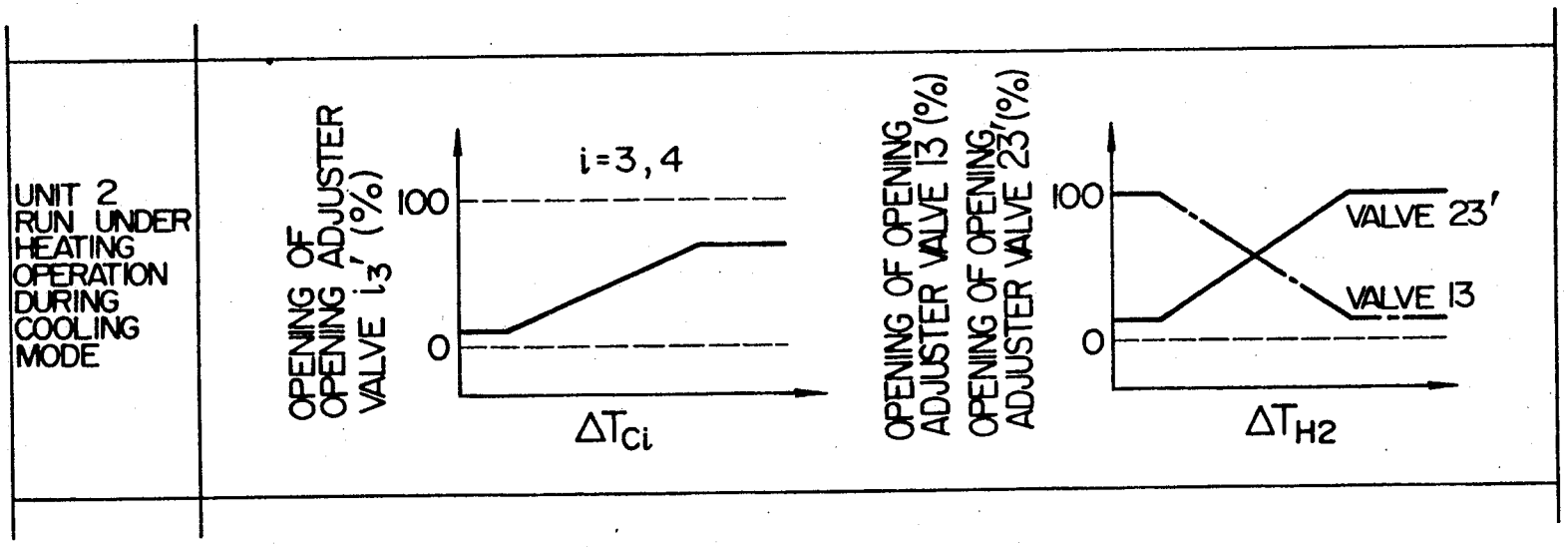

During a running any one indoor unit under the heating operation during a cooling mode in this embodiment, it is assumed that the indoor unit 2 is run under the heating operation, while the indoor units 3, 4 are run under the cooling operation. Under such assumption, the three-way directional control valve 15 is shifted to connect the outlet of the compressor 10 and the outdoor heat exchanger 11. Then, the opening/closing valve 24 is closed and the opening/closing valves 34, 44 are opened. The opening/closing valve 25 is opened and the opening/closing valves 35, 45 are closed. With this valve setting, the high-pressure refrigerant gas delivered from the compressor 10 is distributed to the outdoor heat exchanger 11 of the outdoor unit 1 and the indoor heat exchanger 21 of the indoor unit 2 for being turned to streams of a liquid refrigerant through heat exchanger with air. At this time, the indoor unit 2 carries out heating in the room where it is installed. The respective streams of the liquid refrigerant are joined together after passing through the adjuster valve 13 of the outdoor unit 1 and the adjuster valve 23' of the indoor unit 2, followed by flowing into the adjuster valves 33', 43' of the outdoor units 3, 4. The liquid refrigerant is reduced in pressure by the adjuster valves 33', 43 of the indoor units 3, 4, and then flows into the indoor heat exchangers 31, 41 for heat exchange with the indoor air to air-cool the respective rooms. The refrigerant flowing out of the indoor heat exchangers is suctioned into the compressor 10. In the above process, the adjuster valves 13, 23', 33', 43' are controlled as shown in FIG. 6C. Specifically, when the temperature differential $\Delta T_{Ci}$ in the respective room is large, the indoor units 3, 4 each increase the opening of the adjuster valve to increase a flow rate of the refrigerant for stepping up the cooling capability. When the temperature difference differential $\Delta T_{Ci}$ is small, the opening of the adjuster valve 13' is reduced to reduce a flow rate of the refrigerant for stepping down the cooling capability. Meanwhile, when the temperature differential $\Delta T_{H2}$ for the room of the indoor unit 2 is large, the opening of the adjuster valve 23' is increased and the opening of the adjuster valve 13 of the outdoor unit 1 is reduced, thereby a flow rate of the refrigerant supplied to the indoor unit 2 for stepping up the heating capability. When the temperature differential $\Delta T_{H2}$ is small, the opening of the adjuster valve 23' is reduced and the opening of the adjuster valve 13 is increased, thereby reducing a flow rate of the refrigerant supplied to the indoor unit 2 for stepping down the heating capability.

Figure 6D:
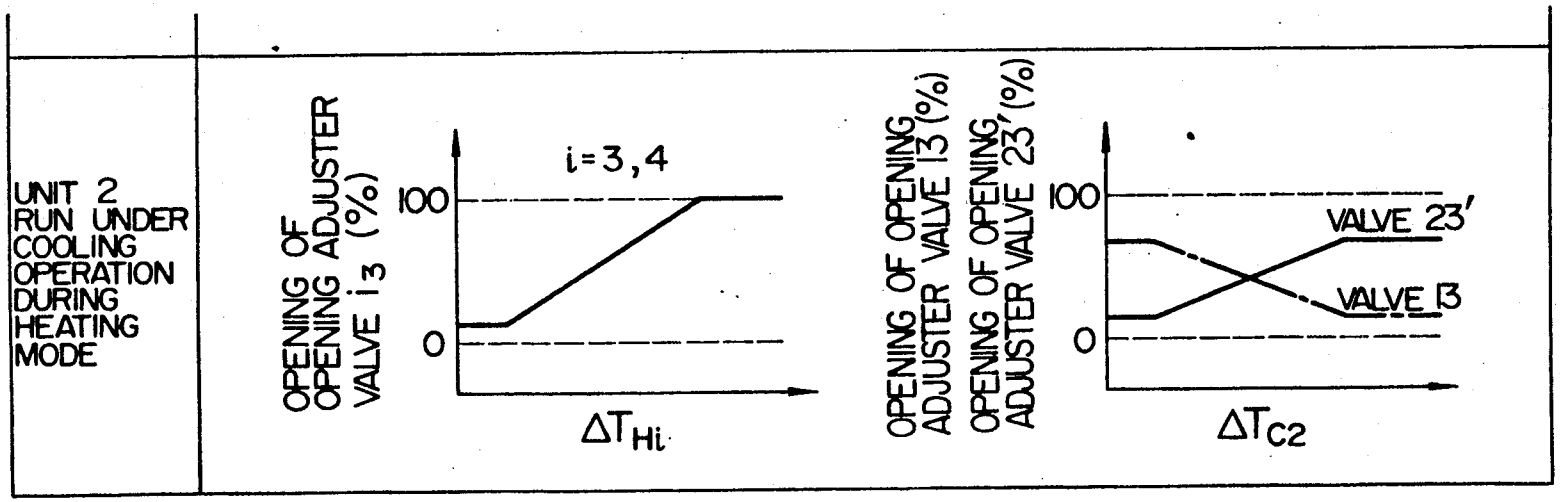

When the indoor unit 2 is run under the cooling operation, while the indoor units 3, 4 are run under the heating operation, the three-way directional control valve 15 is shifted to connect the inlet of the compressor 10 and the outdoor heat exchanger 11. Then, the opening/closing valve 24 is opened and the opening/closing valves 34, 44 are closed. The opening/closing valve 25 is closed and the opening/closing valves 35, 45 are opened. With this valve setting, the high-pressure refrigerant gas delivered from the compressor 10 flows into the indoor heat exchangers 31, 41 of the indoor units 3, 4 while passing through the opening/closing valves 35, 45 for being turned to streams of a liquid refrigerant through heat exchange with the indoor air. At this time, the indoor units 3, 4 carry out heating in the rooms where they are installed. The respective streams of the liquid refrigerant are reduced in pressure by the opening of the adjuster valve 23' of the indoor unit 2 and the opening of the adjuster valve 13 of the outdoor unit 1, followed by a flow of the refrigerant into the indoor heat exchanger 21 and the outdoor heat exchanger 11. In the indoor heat exchanger 21, the refrigerant is subjected to heat exchange with the indoor air for air-cooling. In the outdoor heat exchanger 11, the refrigerant is subjected to heat exchange with the outdoor air. After the heat exchange, the respective refrigerants are joined together at the inlet of the compressor 10 and suctioned therein. In the above process, the adjuster valves 13, 23', 33', 43' are controlled as shown in FIG. 6D. Specifically, when the temperature differential $\Delta T_{Hi}$ in the respective rooms is large, each of the opening of the adjuster valve i3' of the indoor units 3, 4 is increased to increase a flow rate of the refrigerant for stepping up the heating capability. When the temperature differential $\Delta T_{Hi}$ is small, the opening of the adjuster valve i3' is made reduced to reduce a flow rate of the refrigerant for stepping down the heating capability. Meanwhile, when the temperature differential $\Delta T_{C2}$ for the room of the indoor unit 2 is large, the opening of the adjuster valve 23' is increased and the opening of the adjuster valve 13 of the outdoor unit 1 is made smaller in its opening, thereby increasing a flow rate of the refrigerant supplied to the indoor unit 2 for stepping up the cooling capability. When the temperature differential $\Delta T_{C2}$ is small, the opening of the adjuster valve 23' is reduced and the opening of the adjuster valve 13 is increased thereby reducing a flow rate of the refrigerant supplied to the indoor unit 2 for stepping down the cooling capability.

Figure 7:
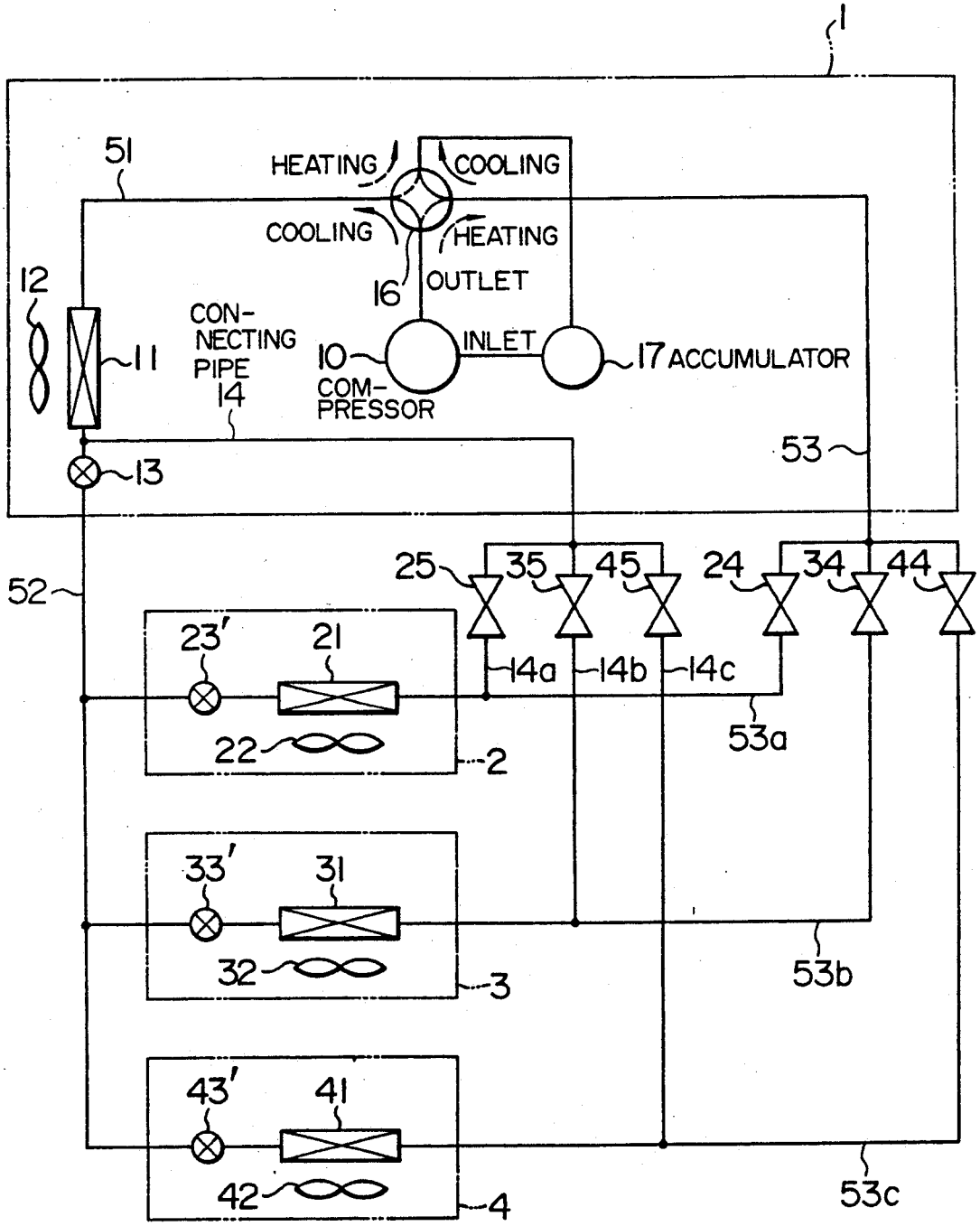
FIG. 7 is a schematic view of a refrigerating cycle showing a third embodiment of the present invention.

In FIG. 7, an outdoor unit 1 houses therein a compressor 10, a four-way directional control valve 16, a first piping line 51, an outdoor heat exchanger 11, a fan 12, an adjuster valve (flow adjusting expansion valve) 13, and an accumulator 17. Indoor units 2, 3, 4 house therein adjuster adjuster valves (flow adjusting expansion valves) 23', 33', 43', indoor heat exchangers 21, 31, 41, and fans 22, 32, 42, respectively, as with the embodiment of FIG. 3. During the cooling operation, the four-way directional control valve 16 is operated to connect an outlet of the compressor 10 and one end of the outdoor heat exchanger 11, as well as to connect the accumulator 17 at the inlet of the compressor 10 and the indoor heat exchangers 21, 31, 41 via solenoid-operated opening/closing valves 24, 34, 44. During the heating operation, the four-way directional control valve 16 is operated to connect the outlet of the compressor 10 and the indoor heat exchangers 21, 31 41 via the first opening/closing valves 24, 34, 44, as well as to connect one end of the outdoor heat exchanger 11 and to connect the accumulator 17 at the inlet of the compressor 10 and the one end of the outdoor heat exchanger 11. The other end of the outdoor heat exchanger 11 and the adjuster valve 13, as well as the adjuster valve 13 and the adjuster valves 23', 33', 43' of the three indoor units 2, 3, 4 are connected to each other by a piping line 52. In the indoor units 2, 3, 4, the adjuster valves 23', 33', 43' are connected to one ends of the indoor heat exchangers 21, 31, 41 by respective piping lines. The other ends of the three indoor heat exchangers 21, 31, 41 are connected by a third piping line 53 to the four-way directional control valve 16 via the first opening/closing valves 24, 34, 44, respectively. Furthermore, piping lines **53*a*, 53*b*, 53*c* between the three indoor heat exchangers 21, 31, 41 and the first opening/closing valves 24, 34, 44 are coupled to the piping line 52 between the outdoor heat exchanger 11 of the outdoor unit 1 and the adjuster valve 13 by connecting pipes 14, 14*a*, 14*b*, 14*c* with second opening/closing valves 25, 35, 45 provided between 14 and 14*a*, 14*b*, 14*c***, respectively.

In the embodiment of FIG. 7, when running all the indoor units 2, 3, 4 under the cooling operation, the four-way directional control valve 16 is shifted into the position for a cooling operation state (cooling mode) as indicated by solid lines at the control valve 16. Then, the first opening/closing valves 24, 34, 44 are opened and the second opening/closing valves 25, 35, 45 are closed. The high-pressure refrigerant gas delivered from the compressor 10 passes through the four-way directional valve 16 and is condensed to a liquid refrigerant in the outdoor heat exchanger 11, followed by flowing into the indoor units 2, 3, 4 through the fully opened adjuster valve 13. In the indoor units 2, 3, 4, the adjuster valves 23', 33', 43' function as expansion valves to reduce the pressure of the liquid refrigerant, which is then subjected to heat exchange with the indoor air in the indoor heat exchangers 21, 31, 41 for cooling the indoor air. After heat exchange, the refrigerant enters the accumulator 17 through the solenoid valves 24, 34, 44 and the four-way directional control valve 16 for separation into gas and liquid. Only the refrigerant gas is suctioned into the compressor 10 for compression.

When running all the indoor units 2, 3, 4 under the heating operation, the four-way directional control valve 16 is shifted into the position for a heating operation state as indicated by broken lines at the control valve 16 in FIG. 7. The high-pressure refrigerant gas delivered from the compressor 10 passes through the four-way directional valve 16 and the first opening/closing valves 24, 34, 44, followed by flowing into the indoor heat exchangers 21, 31, 41 of the indoor units 2, 3, 4 to be condensed to liquid refrigerant through heat exchange with the indoor air. At this time, the indoor air is warmed for heating of the respective rooms. The liquid refrigerant then flows into the outdoor unit 1 through fully opened adjuster valves 23', 33', 43'. The refrigerant flowing into the outdoor unit 1 is reduced in pressure by the opening adjuster valve 13 which functions as an expansion valve, and is then subjected to heat exchange with the outdoor air in the outdoor heat exchangers 11. Afterward, the refrigerant is suctioned into the compressor 10 through the four-way directional control valve 16 and the accumulator 17 for compression.

Upon a running of the indoor unit 2 under the heating operation while the indoor units 3, 4 are run under the cooling operation, for example, the four-way directional control valve 16 is shifted into the position for a cooling operation state (cooling mode). Then, the opening/closing valve 24 is closed and the opening/closing valves 34, 44 are opened. The opening/closing valve 25 is opened and the opening/closing valves 35, 45 are closed. With this valve setting, a portion of the high-pressure coolant discharged from the outdoor heat exchanger 11 of the outdoor unit 1 flows into the indoor unit 2 through the opening/closing valve 25 for heat exchange with the indoor air in the indoor heat exchanger 21 for heating the indoor air. The remaining high-pressure refrigerant passes from the outdoor heat exchanger 11 through the adjuster valve 13 and is joined with the high-pressure refrigerant having passed through the indoor unit 2, followed by flowing into the indoor units 3, 4 to air-cool the respective rooms.

With a running of the indoor unit 2 under the cooling operation while the indoor units 3, 4 are run under the heating operation, the four-way directional control valve 16 is shifted into the position for a heating operation state (heating mode). Then, the opening/closing valve 24 is closed and the opening/closing valves 34, 44 are opened. The opening/closing valve 25 is opened and the opening/closing valves 35, 45 are closed. With this valve setting, the refrigerant turned to the form of a liquid after the heating operation in the indoor units 3, 4 is distributed to the adjuster valve 23' of the indoor unit 2 and the adjuster valve 13 of the outdoor unit 1. The adjuster valve 23' of the indoor unit 2 functions as an expansion valve to air-cool the room in which the indoor unit 2 is installed. The refrigerant flowing out of the indoor unit 2 passes through the opening/closing valve 25 and is joined with the remaining refrigerant having passed through the adjuster valve 13 of the outdoor unit 1. The joined refrigerant enters the outdoor heat exchanger 1 for heat exchange with the outdoor air, followed by being suctioned into the compressor 10. The opening adjuster valves 13, 23', 33', 43' are controlled in a manner similar to that shown in FIGS. 4 through 6D. Moreover, upon operating some of the indoor units under the heating operation during a cooling mode, the fan 12 of the outdoor unit 1 is lowered in its rotational speed if the sufficient heating capability cannot be provided. This reduces an amount of heat exchange in the outdoor heat exchanger 11 and increases an amount of heat exchange in the indoor unit under the heating operation to step up the heating capability thereof. Also, upon operating some of the indoor units under the cooling operation during a heating mode, the fan 12 of the outdoor unit 1 is lowered in its rotational speed if the high-pressure refrigerant gas delivered from the compressor 10 takes an abnormally high temperature. This reduces an amount of heat exchange in the outdoor heat exchanger 11, whereby the refrigerant suctioned into the compressor 10 has a smaller enthalpy to prevent the temperature of the delivered refrigerant gas from rising to an abnormal value.

A fourth embodiment of the present invention will be described below with reference to FIG. 8. Although In FIG. 8, although one end of the connecting pipe 14 is connected to the piping line between the outdoor heat exchanger 11 and the adjuster valve 13 in the embodiment of FIG. 7, one end of the connecting pipe is connected to an accumulator 17 in the embodiment of FIG. 8.

Figure 8:
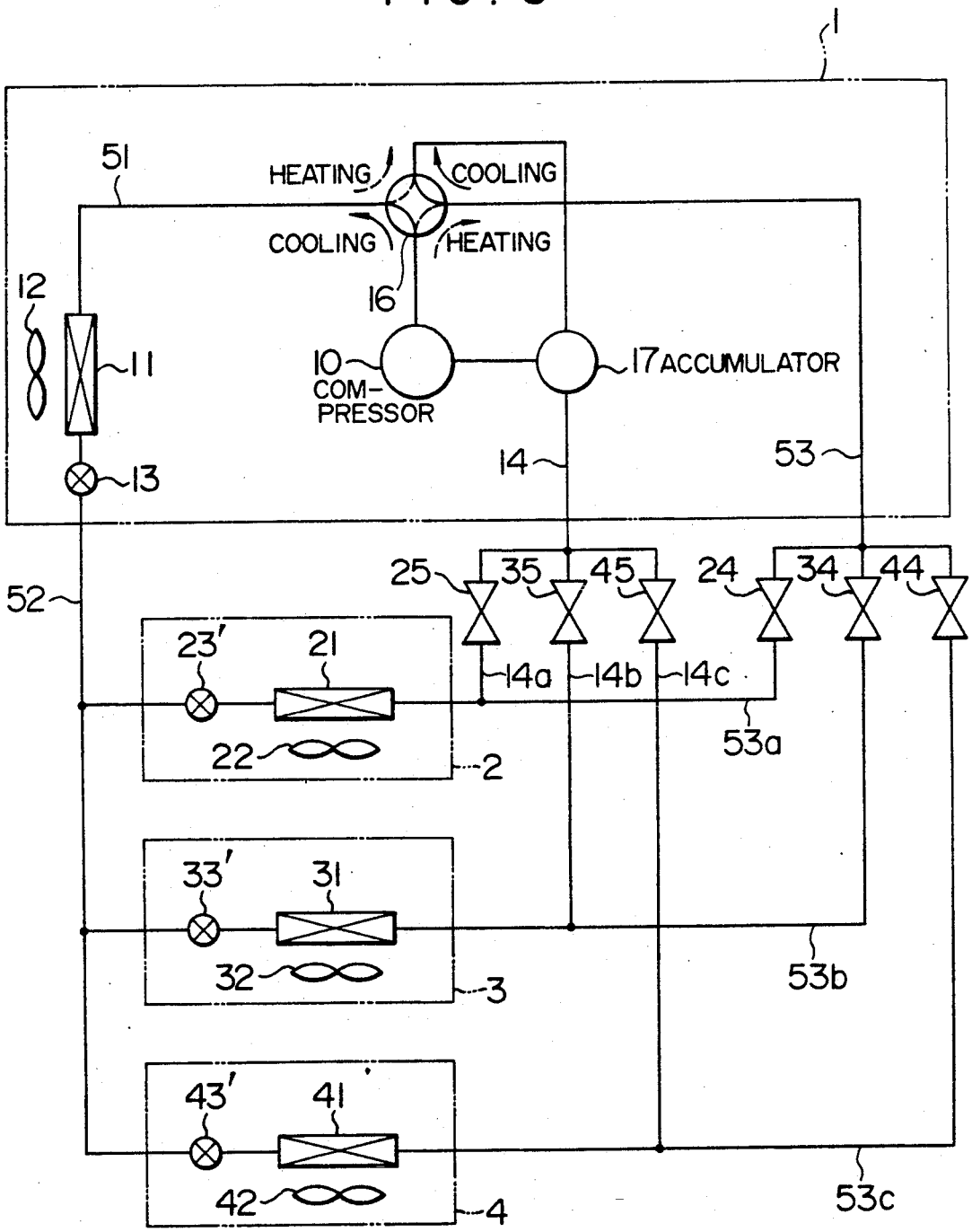
FIG. 8 is a schematic view of a refrigerating cycle showing a fourth embodiment of the present invention.

In FIG. 8, when running all the indoor units 2, 3, 4 under the cooling or heating operation, the first opening/closing valves 24, 34, 44 are opened, the second opening/closing valves 25, 35, 45 are closed, and the four-way directional control valve 16 is shifted into the position for a cooling or heating operation state, as with the embodiment of FIG. 7. The adjuster valves 13, 23', 33', 43' are controlled as shown in FIGS. 6A and 6B manner similar to the embodiment of FIG. 3.

In a combined cooling/heating combined operation, the four-way directional control valve 16 is shifted into the position for a heating mode for running the entire air conditioner under the heating operation as a main mode. Upon bringing any one indoor unit, e.g., the indoor unit 2, into the cooling operation, the opening/closing valve 24 is closed and the opening/closing valve 25 is opened. When only one of the three indoor units is operated under the cooling operation, while operating the other two units in the heating operation, it may happen that if the adjuster valve 13 is fully closed, all the refrigerant is caused to flow into the indoor unit 2 under the cooling operation so as to results in an inbalance in the amount of heat between the indoor units under the heating operation and the indoor unit under the cooling operation. In this case, the opening adjuster valve 13 is not fully closed, but regulated in its opening for returning a portion of the coolant to the compressor 10 via the outdoor heat exchanger. In other words, the opening adjuster valves 13, 23', 33', 43' are controlled as shown in FIG. 6D in a like manner to the embodiment of FIG. 3.

Figure 9:
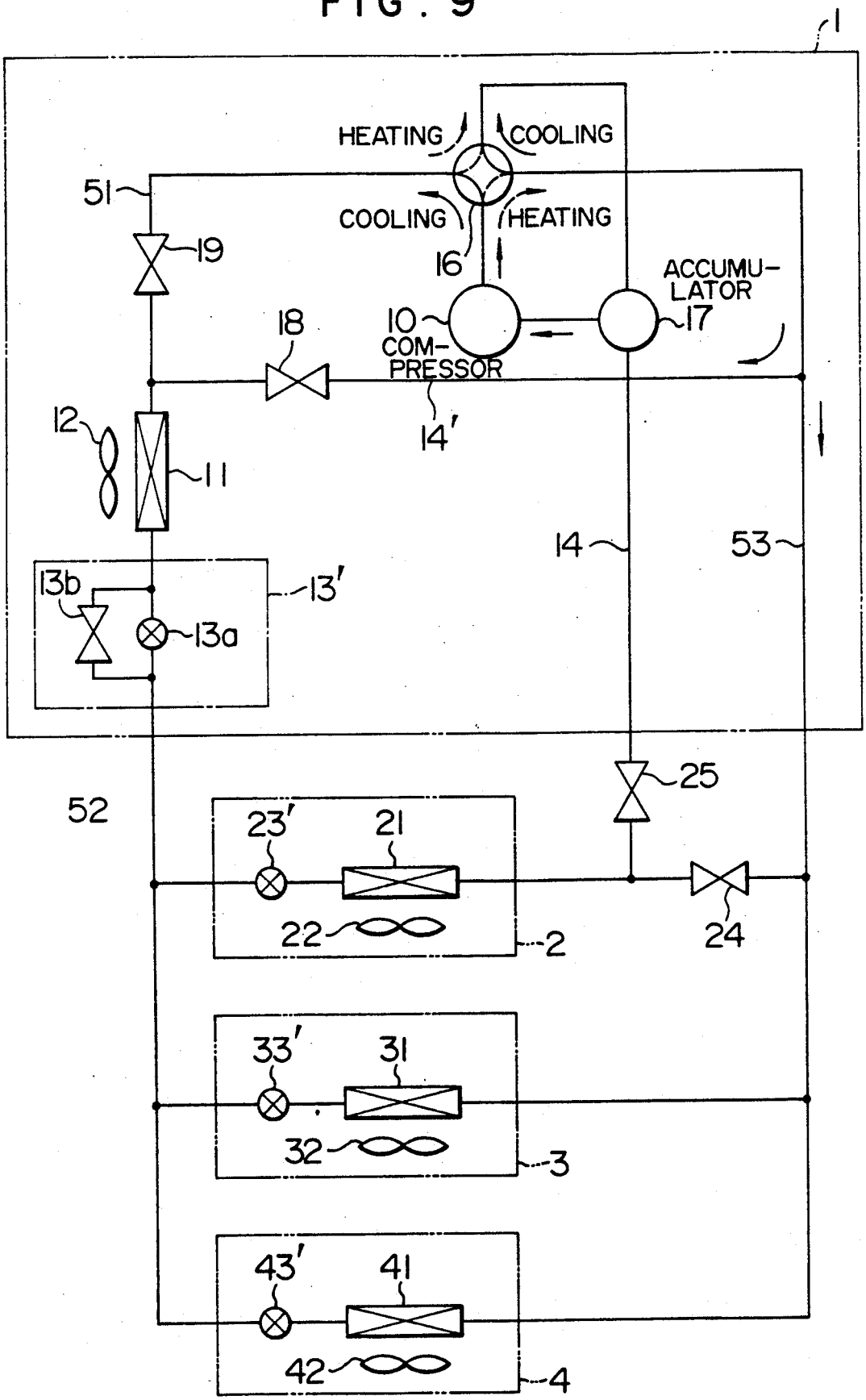
FIG. 9 is a schematic view of a refrigerating cycle showing a fifth embodiment of the present invention.

In FIG. 9, only one indoor unit 2 of the three indoor units 2, 3, 4 of the embodiment of FIG. 8 is provided with a first connecting pipe 14, a first opening/closing valve 24 and a second opening/closing valve 25. A third opening/closing valve 19 is provided in a first piping line 51 connecting a four-way directional control valve 16 and an outdoor exchanger 11. Also, the first piping line 51 between the third opening/closing valve 19 and the outdoor heat exchanger 11 is coupled to a third piping line 53 connecting the four-way directional control valve 16 and the first opening/closing valve 24 by a second connecting pipe 14' provided with a fourth opening/closing valve 18. In FIG. 9, an adjuster mechanism 13' is further provided by connecting an opening adjuster valve **13*a* and a solenoid valve 13*b* in parallel. This embodiment is effective when the indoor unit 2** is installed in a room where a larger amount of heat is produced, e.g., a room with office automation equipment, to air-cool the room even in the winter season.

Figure 10:
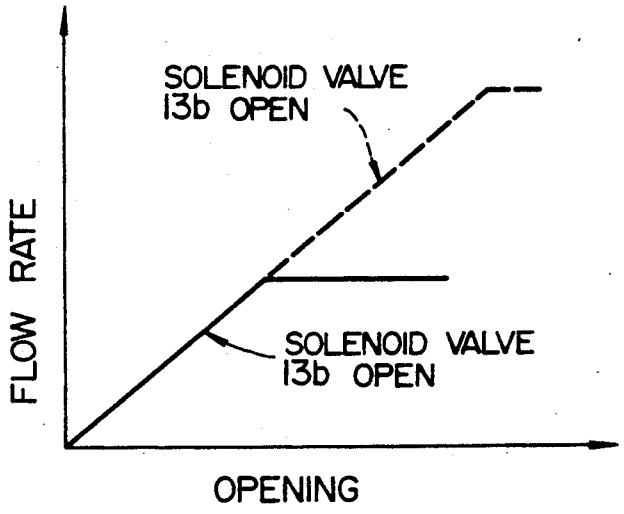
FIGS. 10 and 11(*a*)-11(*c*) are graphs for explaining control of the embodiment of FIG. 9.

As shown in FIG. 10, when the flow rate of the coolant passing through the adjuster mechanism 13' is small, the flow rate is regulated in dependence upon an of the opening adjuster valve **13*a* with the solenoid valve 13*b* being closed. When the flow rate of the coolant passing through the adjuster mechanism 13' is large, the flow rate is regulated in dependence upon an of the opening adjuster valve 13*a* with the solenoid valve 13*b* being opened. Thus, combined use of the solenoid valve 13*b* and the adjuster valve 13*a*, which jointly constitute the opening adjuster mechanism 13'**, enables a regulation of the flow rate of the refrigerant ranging from a small value to a large value.

The control configuration is similar to the control configuration of FIG. 4. The compressor driving frequency is varied in dependence upon the maximum load $Q_{max}$ as stated before in connection with FIG. 5. When the total heating load $Q_H \leqq 0$, i.e., in the case of no heating load, the arithmetic unit C in FIG. 4 outputs a signal to shift the four-way directional control valve 16 into a cooling mode. When the total heating load $Q_H > 0$, i.e., in the case of heating load being produced, the arithmetic unit C outputs a signal to shift the four-way directional control valve 16 into a heating mode.

Figure 11A:
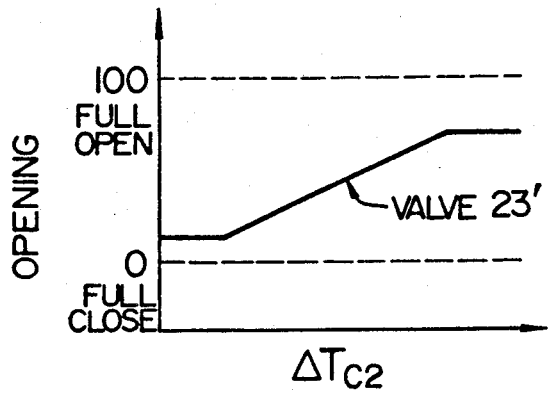
Figure 11B:
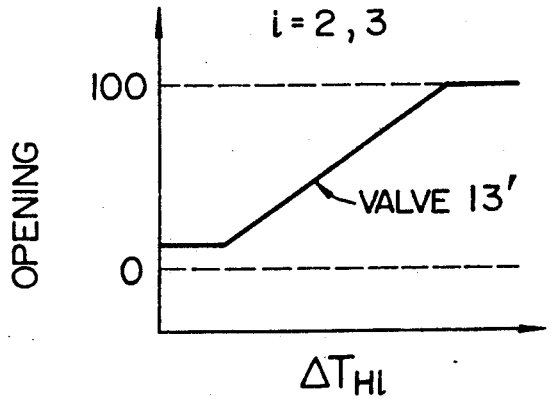
Figure 11C:
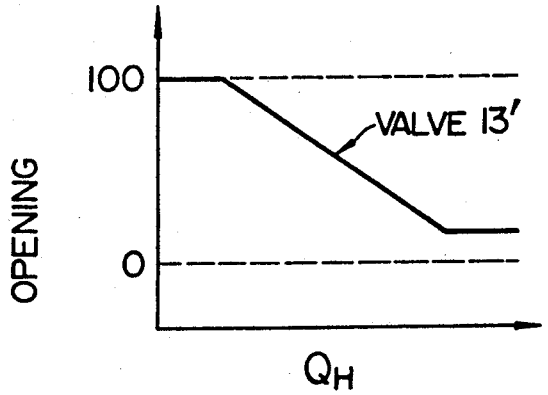
Figure 12:
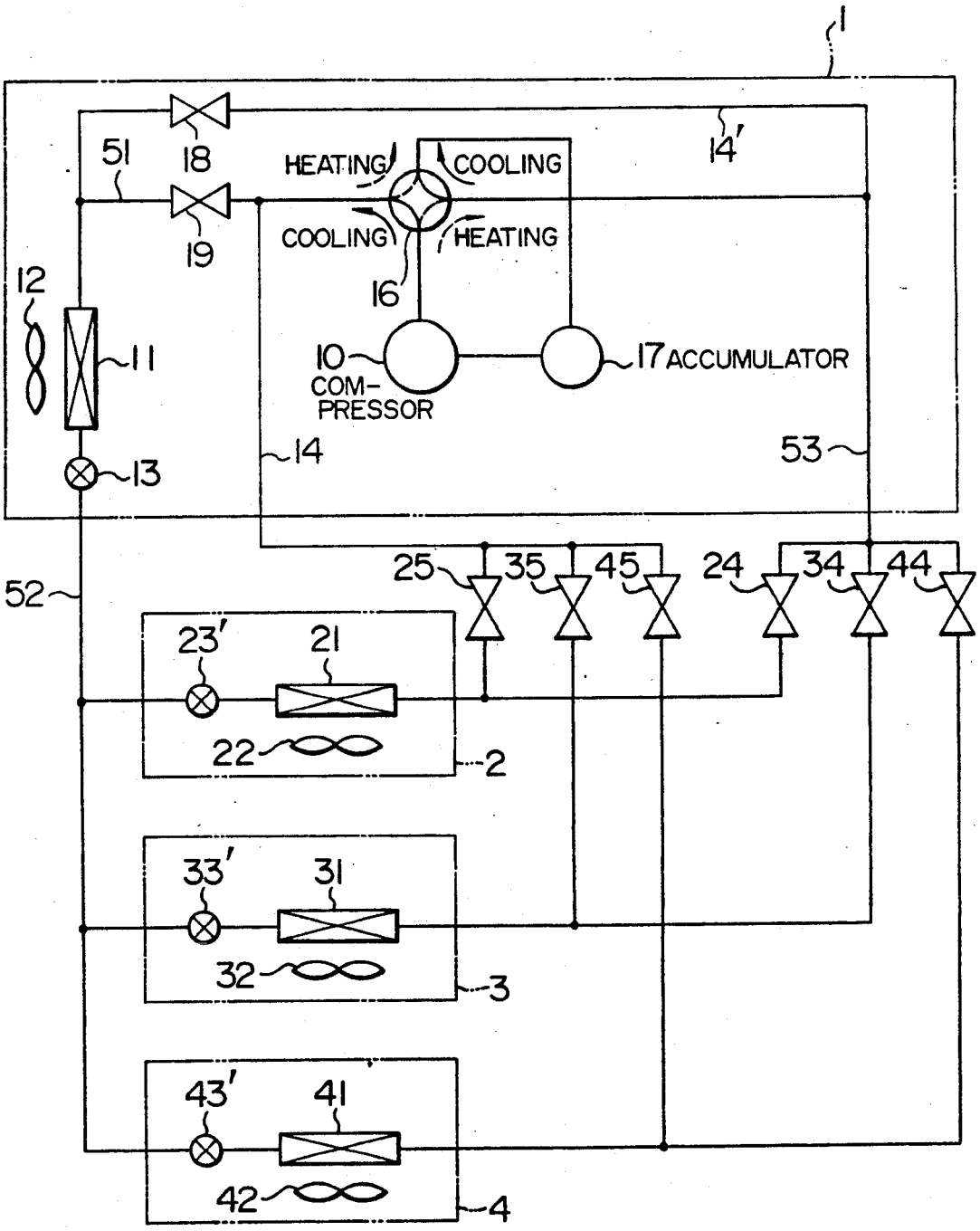
FIG. 12 is a schematic view of a refrigerating cycle showing a sixth embodiment of the present invention.

When the total heating load $Q_H \leqq 0$ or the total cooling load $Q_C \leqq 0$, i.e., when all the indoor units 2, 3, 4 are run under the cooling or heating operation, the opening/closing valves 19, 24 are opened and the opening/closing valves 18, 25 are closed. The adjuster valves 23', 33', 43' are controlled as shown in FIGS. 6A or 6B. The adjuster valve 13a is controlled as with the adjuster valve 13 in FIG. 7. When the indoor unit 2 is operating in the cooling operation, while the indoor units 3, 4 are operated in the heating operation, the first opening/closing valve 24 is closed and the second opening/closing valve 25 is opened. When the total heating load $Q_H \geqq$ the total cooling load $Q_C$ + the input load EW, i.e., when the heating load $Q_H$ of the indoor units 3, 4 is not smaller than the sum of the cooling load $Q_C$ of the total indoor unit 2 and the input load EW of the compressor, the third opening/closing valve 19 is opened and the fourth opening/closing valve 18 is closed. The adjuster valve 13a is controlled in a manner similar to that shown in FIG. 6D. With the above control manner, the embodiment operates in the same manner as the embodiment of FIG. 8. When the total heat load $Q_H <$ the total cooling load $Q_C$ + the input load EW holds, the third opening/closing valve 19 is closed and the fourth opening/closing valve 18 is opened. The adjuster valve 13a is controlled as shown in FIGS. 11(a)–11(c). With such control, the high-pressure refrigerant gas from the compressor 10 is distributed via the fourth opening/closing valve 18 to the outdoor heat exchanger 11 and the indoor heat exchangers 31, 41 where the refrigerant gas is turned to streams of a liquid refrigerant through heat exchange with air. The liquid refrigerant from the outdoor heat exchanger 11 passes through the opening adjuster mechanism 13' and the liquid refrigerant from the indoor heat exchangers 31, 41 pass through the adjuster valves 33', 43', followed by joining together to enter the indoor unit 2. The liquid refrigerant entering the indoor unit 2 is reduced in pressure by the adjuster valve 23' and subjected to heat exchange with air in the indoor heat exchanger 21. Afterward, the refrigerant enters the accumulator 17 via the second opening/closing valve 25 and is suctioned into the compressor 10. In this way, by also distributing the high-pressure refrigerant gas to the outdoor unit 1, during the heating operation, it is possible to make the total heating load $Q_H$ of the indoor units smaller than the sum of the total cooling load $Q_C$ and the input load EW of the compressor. The embodiment of FIG. 12 represents a modification of the embodiment shown in FIG. 8, wherein one end of the first connecting pipe 14, coupled to the accumulator 17, is connected to the first piping line 51 between the four-way directional control valve 16 and the outdoor heat exchanger 11. A third opening/closing valve 19 is provided between the above joint point and the outdoor heat exchanger 11. Further, the first piping line 51 between the third opening/closing valve 19 and the outdoor heat exchanger 11 is coupled to the third piping line 53 between the four-way directional control valve 16 and the first opening/closing valves 24, 34, 44 by a second connecting pipe 14' provided with a fourth opening/closing valve 18.

The operation of this embodiment will be described below with reference to FIGS. 13A–13C and 14A–14C.

Figure 13A:
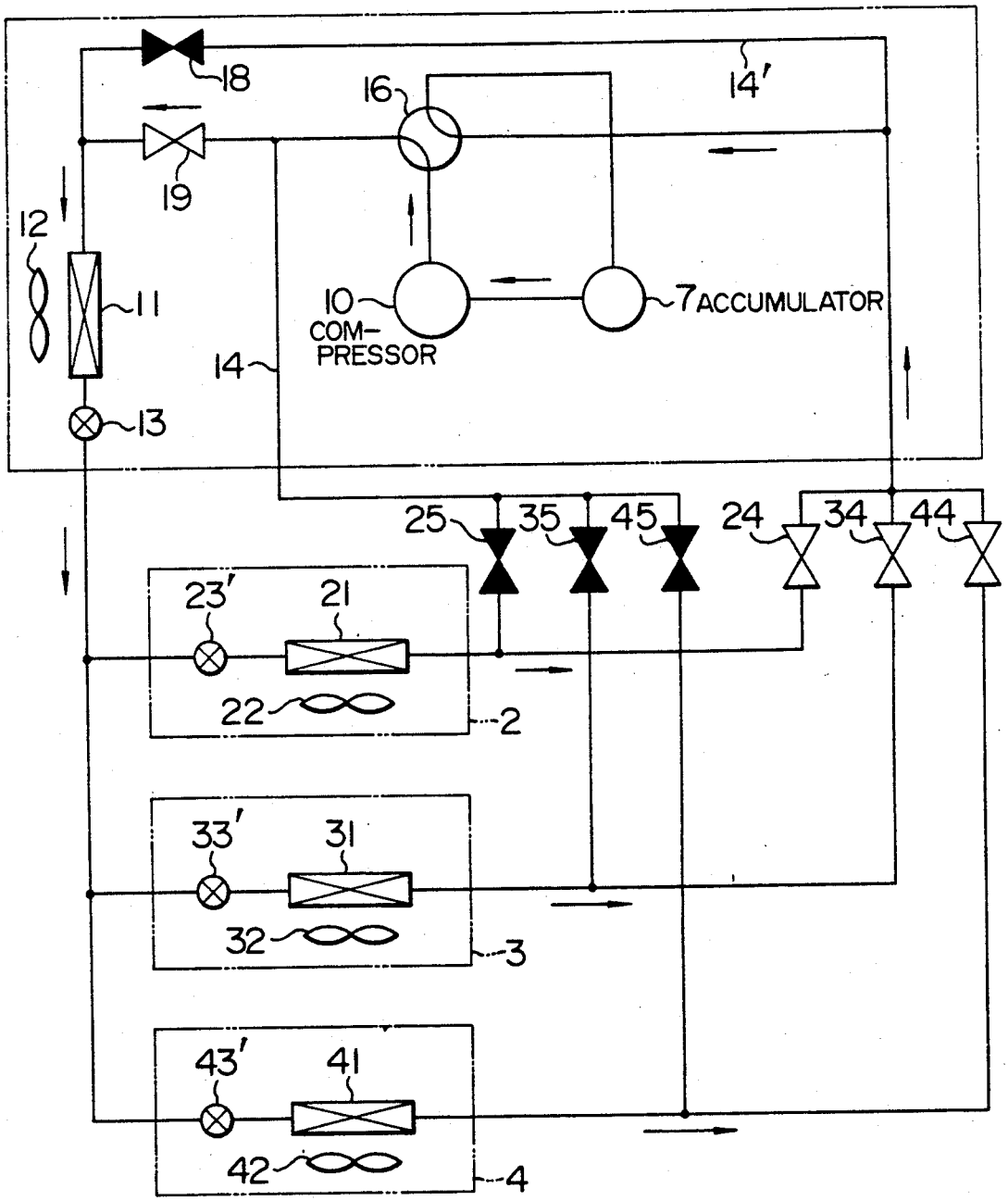
FIGS. 13A, 13B, 13C, 14A, 14B and 14C are diagrammatic views for explaining the operation of the embodiment of FIG. 12.
Figure 13B:
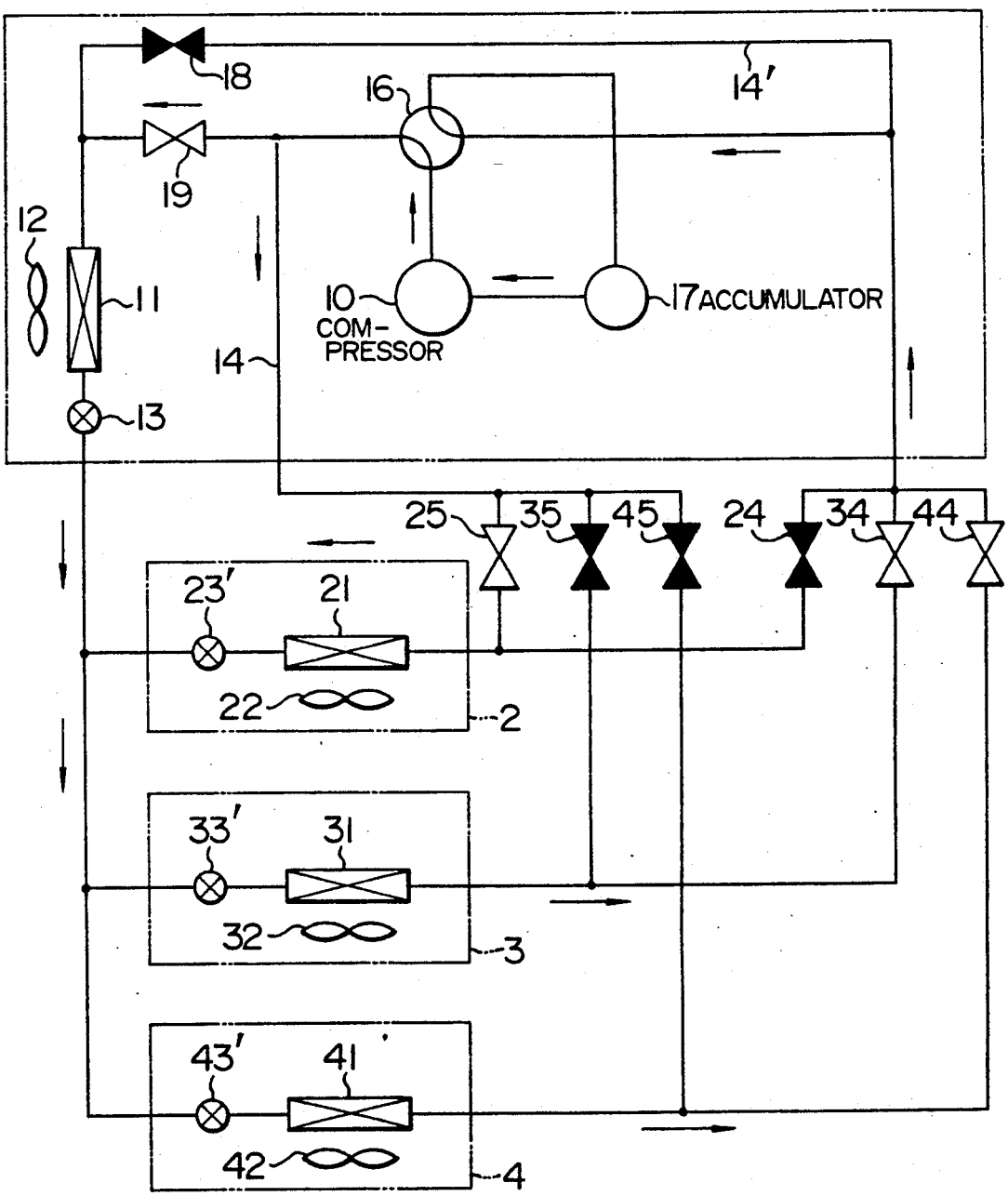
Figure 13C:
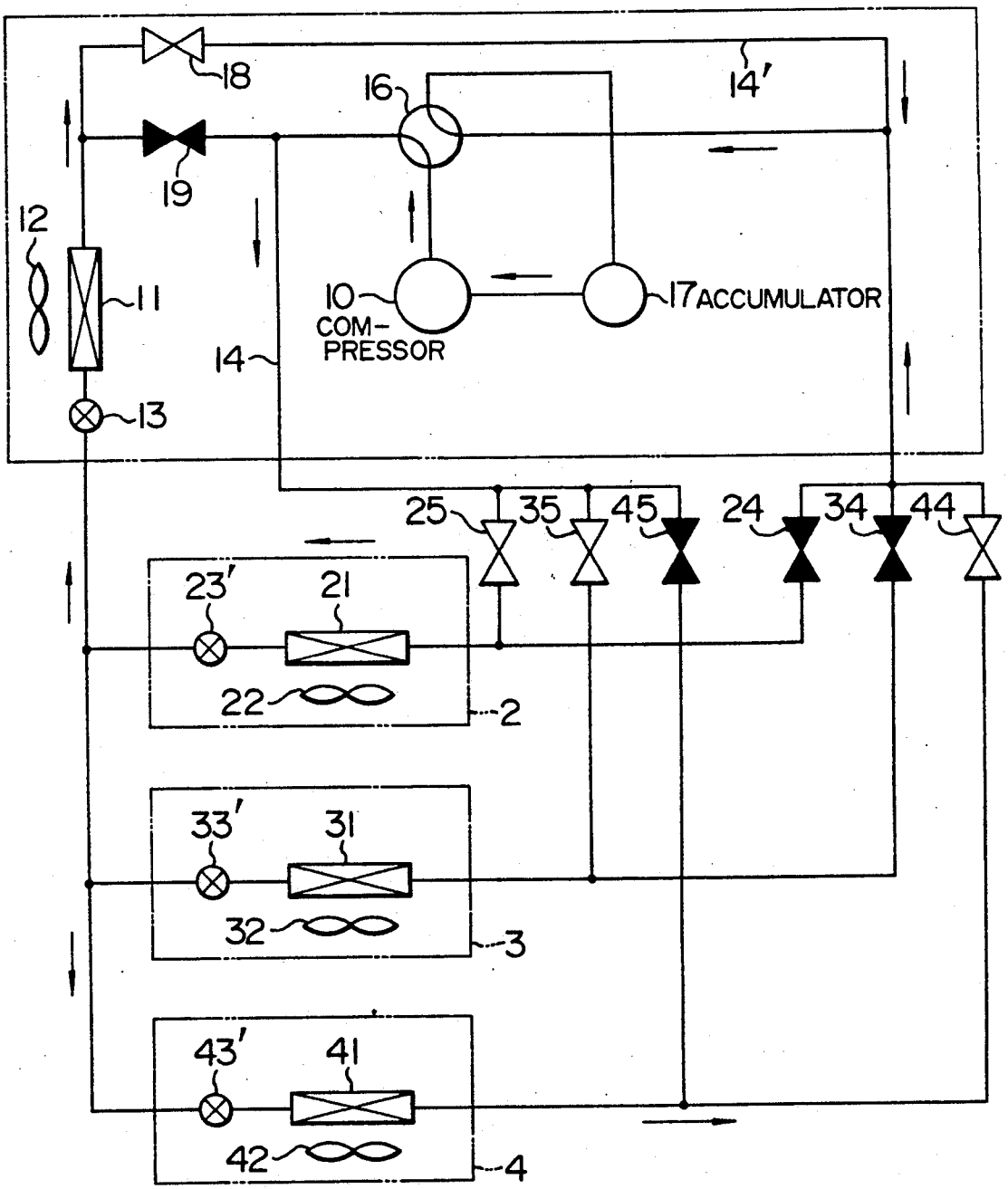

FIG. 13A shows the case of operating all the indoor units 2, 3, 4 during the cooling operation. The four-way directional control valve 16 is shifted into the position for a cooling mode. Then, the opening/closing valves 18, 25, 35, 45 are closed and the opening/closing valves 19, 24, 34, 44. With this valve setting, the refrigerant gas delivered from the compressor 10 passes through the opening/closing valve 19 and is condensed to a liquid refrigerant in the outdoor heat exchanger 11, followed by flowing into the indoor units 2, 3, 4. The liquid refrigerant is reduced in pressure by the adjuster valves 23', 33', 43' and subjected to heat exchange with air in the heat exchangers 21, 31, 41 for cooling the indoor air. Afterward, the coolant is suctioned into the compressor 10 through the opening/closing valves 24, 34, 44. Next, when bringing only one indoor unit 2 into the heating operation from the above state, the opening/closing valve 25 is opened and the opening/closing valve 24 is closed as shown in FIG. 13B. With this valve setting, a flow line of the refrigerant gas delivered from the compressor 10 is branched into a flow line leading to the outdoor heat exchanger 11 through the opening/closing valve 19 and a flow line leading to the indoor unit 2 through the first connecting pipe 14 and the opening/closing valve 25. The indoor unit 2 carries out heating in the room where it is installed. The refrigerant gas is turned to streams of a liquid refrigerant in the heat exchangers 11, 21, while flowing through the indoor units 3, 4 to air-cool the respective rooms. Afterward, the refrigerant is suctioned into the compressor 10 through the opening/closing valves 33, 44. Further, when also bringing the indoor unit 3, into the heating operation from the above state, the opening/closing valve 35 is opened and the opening/closing valve 34 is closed, while the opening/closing valve 19 is closed and the opening/closing valve 18 is opened, as shown in FIG. 13C. With this valve setting, the refrigerant gas delivered from the compressor 10 flows into the indoor units 2, 3 through the first connecting pipe 14 and the opening/closing valves 25, 35 for heating the respective rooms. The refrigerant gas is turned through the heat exchangers 21, 31 to streams of a liquid refrigerant which are then distributed to the outdoor heat exchanger 11 and the indoor unit 4. The liquid refrigerant flowing into the indoor unit 4 is reduced in pressure by the adjuster valve 43' to cool the indoor air, followed by being suctioned into the compressor 10 through the opening/closing valve 44. The liquid coolant flowing to the side of the outdoor heat exchanger 11 is reduced in pressure by the adjuster valve 13 and enters the outdoor heat exchanger 11 for evaporation. The refrigerant gas is then suctioned into the compressor 10 through the fourth opening/closing valve 18. Note that the cooling operation of the indoor unit 4 may be stopped in the above process. In this case, the adjuster valve 43' is fully closed.

Figure 14A:
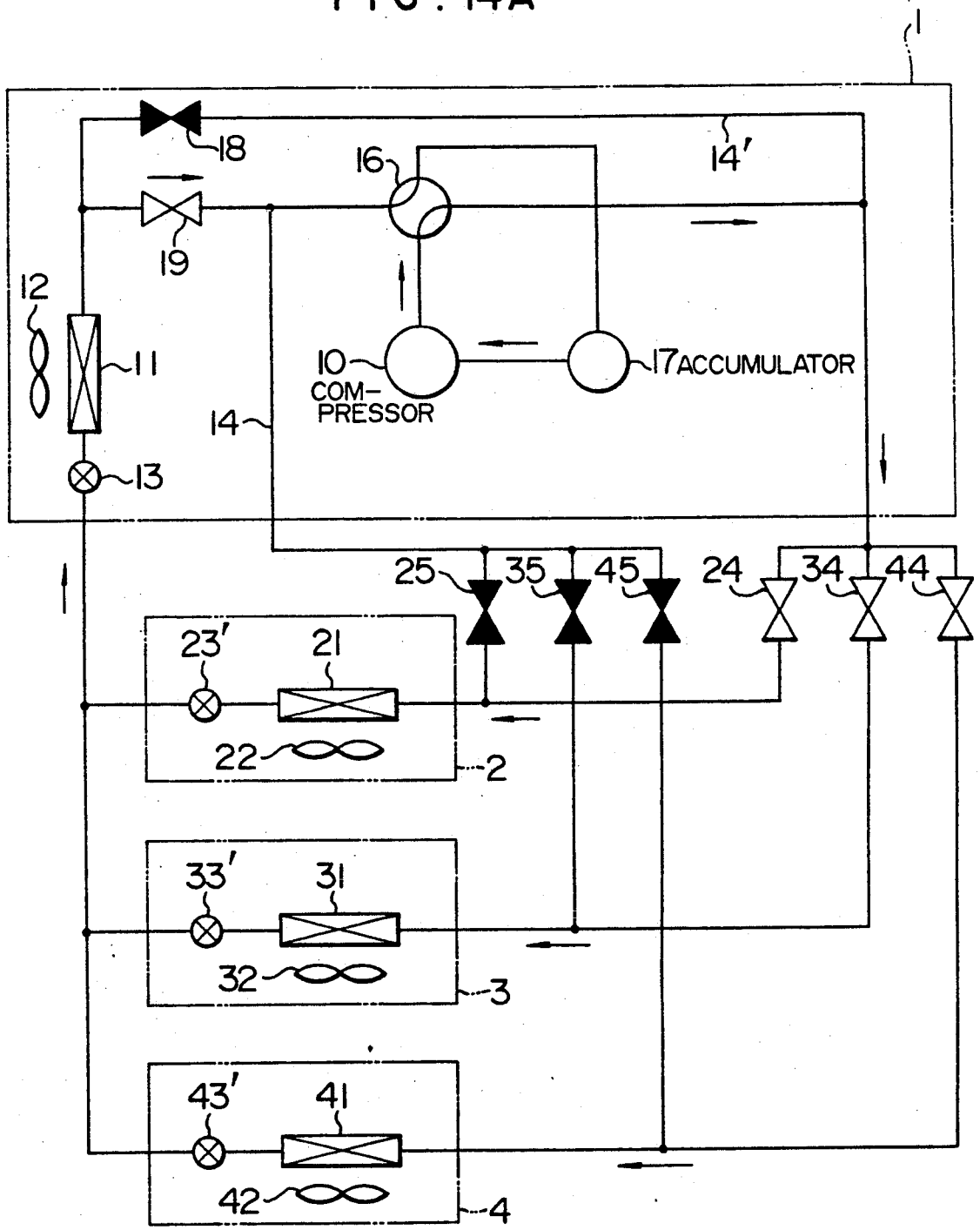
Figure 14B:
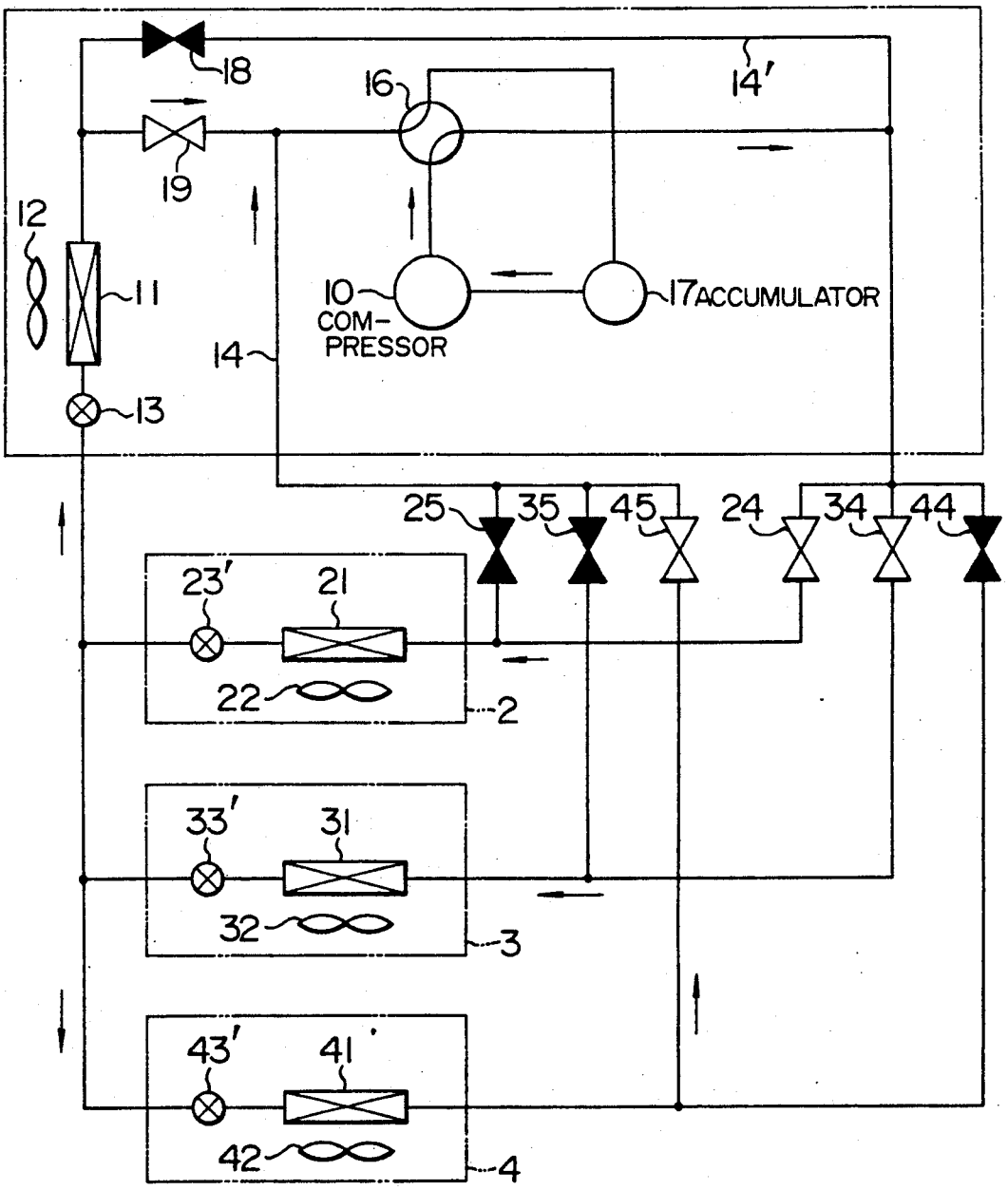
Figure 14C:
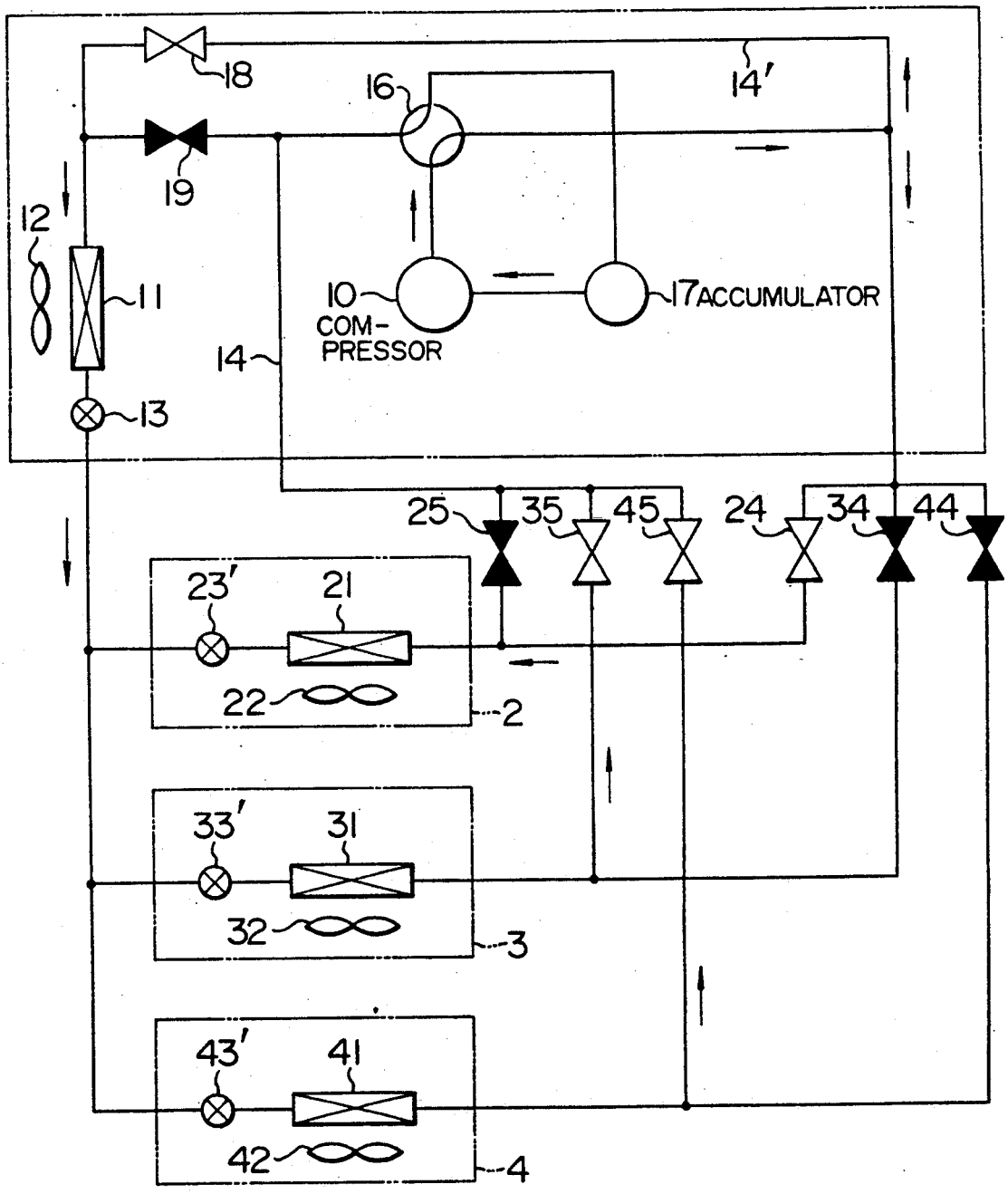

FIG. 14A shows the case of operating all the indoor units 2, , 4 under the heating operation. The four-way directional control valve 16 is shifted into the position for a heating mode. Then, the opening/closing valves 18, 25, 35, 45 are closed and the opening/closing valves 19, 24, 34, 44. With this valve setting, the refrigerant gas delivered from the compressor 10 passes through the opening/closing valves 24, 34, 44 and enters the indoor units 2, 3, 4 for heating the respective rooms. The refrigerant gas is turned to a liquid refrigerant in the heat exchangers 21, 41, 41 of the indoor units 2, 3, 4. The liquid refrigerant is reduced in pressure by the adjsuter valve 13 of the outdoor unit 1 and enters the outdoor heat exchanger 11 for evaporation. The refrigerant gas is then suctioned into the compressor 10 through the third opening/closing valve 19. When bringing the indoor unit 4 into the cooling operation from the above state, the opening/closing valve 45 is opened and the opening/closing valve 44 is closed as shown in FIG. 14B. With this valve setting, the refrigerant gas delivered from the compressor 10 flows into the indoor units 2, 3 through the opening/closing valves 24, 34 for heating the respective rooms. The refrigerant gas is turned in the heat exchangers 21, 31 to streams of a liquid refrigerant which are then distributed to the outdoor heat exchanger 11 and the indoor unit 4. In the indoor unit 4, the refrigerant gas is reduced in pressure by the adjuster valve 43' to cool the indoor air, followed by being suctioned into the compressor 10 through the opening/closing valve 45 and the first connecting pipe 14. On the other hand, the liquid refrigerant flowing to the side of the outdoor heat exchanger 11 is reduced in pressure by the adjuster valve 13 and enters the outdoor heat exchanger 11 for evaporation. The refrigerant gas is then suctioned into the compressor 10 through the third opening/closing valve 19. Further, when also bringing the indoor unit 3 into the cooling operation from the above state, the opening/closing valve 35 is opened and the opening/closing valve 34 is closed, while the third opening/closing valve 19 is closed and the fourth opening/closing 18 is opened, as shown in FIG. 14C. With this valve setting, a flow line of the refrigerant gas delivered from the compressor 10 is branched into a flow line leading to the indoor unit 2 through the opening/closing valve 24 and a flow line leading to the outdoor heat exchanger 11 through the second connecting pipe 14' and the fourth opening/-closing valve 18. The indoor unit 2 carries out heating in the room where it is installed. The refrigerant gas is turned to streams of a liquid refrigerant in the heat exchangers 11, 21. After joining of the two streams, the liquid refrigerant is distribted to the indoor units 3, 4 to air-cool the respective rooms. Afterward, the refrigerant is suctioned into the compressor 10 through the opening/closing valves 35, 45 and the first connecting pipe 14. Note that the heating operation of the indoor unit 2 may be stopped in the above process. In this case, the opening/closing valve 24 is closed and the opening adjuster valve 23' is also closed.

As described above, when operating the indoor units in a mode other than operating all the rooms in a cooling or heating mode, i.e., when operating the two indoor units under the cooling operation and the remaining indoor unit under the heating operation, or when stopping the operation of any one indoor unit, the four-way directional control valve 16 may be set into any one of the positions for a cooling mode and a heating mode for such operation. This permits a reduction in the number of times that the four-way directional control valve is shifted. Four-way directional control valves are shorter in service life than solenoid valves. With this embodiment, however, since the shifting frequency of four-way directional control valve can be reduced remarkably, it is possible to prevent failure of the four-way directional control valve and hence greatly prolong its service life.

Further, with the embodiment of FIG. 12, all the indoor units can be run under the heating operation with the four-way directional control valve being set to a cooling mode, or under the cooling operation with the four-way directional control valve being set to a heating mode. Accordingly, the embodiment of FIG. 12 does not necessarily require the four-way directional control valve, and can also run the respective indoor units under the cooling or heating operation in any desired combinations without the four-way directional control valve. Moreover, even when the amount of heat is out of balance between the indoor unit(s) under the cooling operation and the indoor unit(s) under the heating operation, the heat balance can be recovered by properly regulating respective openings of the adjuster valves 13, 23', 33', 43', resulting in an air conditioner which is energy-saving and affords more comfortable air-conditioning.

Although the three indoor units are used in the above-described embodiments, the number of indoor units may be two or four or more. Although the indoor units are all operated in the above described manner, the indoor units can also be run while stopping a part of them. In the case, the fan of the indoor unit to be stopped is deenergized and the associated opening adjuster valve or opening/closing valve is closed. In this case, since the total flow rate of the refrigerant is reduced, the operation is controlled to reduce the capacity of the compressor and the rotational speed of the fan of the outdoor unit is lowered.

According to the present invenvention, the following advantageous effect result. During the combined cooling/heating operation, the indoor heat exchanger under a reverse mode can be supplied with the refrigerant at a required flow rate by restricting the flow line on the side of the outdoor heat exchanger via the opening adjuster valve. This enables a preventing in a reduction in the capability of the operation in a reverse mode, and ensures comfortable air-conditioning in the respective rooms.

By fully closing the adjuster valve of the outdoor unit, the indoor heat exchanger(s) under the cooling operation and the outdoor heat exchanger(s) under the heating operation can be connected in series to pass a larger amount of the refrigerant to the respective indoor heat exchangers. This is effective in preventing reduction in the capability of the indoor heat exchanger(s) operated under a reverse mode.

As fully described above, even in the case of the cooling/heating combined operation where one or more of plural indoor units are run under the cooling operation and all or a part of the remaining indoor units are run under the heating operation, it is possible to ensure sufficient flow rates of the refrigeration supplied to the respective indoor units, and prevent deficiency of the capability for all the indoor units.

In the embodiments of the present invention employing the opening adjuster valves each of which serves as an expansion valve and can adjust a flow rates of the refrigerant, the flow rates of the refrigerant supplied to the respective indoor units can be controlled arbitrarily so as to provide comfortable air-conditioning.

Particularly, in the embodiment of the present invention employing the second connecting pipe, the refrigerant can reliably be supplied to the respective indoor units at flow rates as large as required, which provides very comfortable air-conditioning. Also, use of the four-way directional control valve permits a reduction in the number of times that the valve is shifted.

What is claimed is:

1. An air conditioner in which a compressor, an outdoor heat exchanger, and a plurality of indoor heat exchangers connected in parallel are coupled with each other, the air conditioner comprising an opening adjuster valve provided in association with said outdoor heat exchanger on a side leading to said indoor heat exchangers and serving as an expansion valve; opening adjuster valves respectively provided in association with each of said indoor heat exchangers on the side leading to said outdoor heat exchanger and serving as expansion valves; first opening/closing valves respectively provided in association with said indoor heat exchangers on a side leading to the inlet side of said compressor; a directional control valve provided midway of a piping line for connecting said outdoor heat exchanger and said outlet side of said compressor, said directional control valve constructed so as to provide at least a three-way directional control; further piping lines for respectively connecting a joint between the outlet side of said compressor and said directional control valve to joints between said indoor heat exchangers and said first opening/closing valves; second opening/-closing valves respectively provided in said further piping lines on sides leading to said indoor heat exchangers; and an additional piping line provided with an opening/closing valve for leading compressed coolant to the outdoor heat exchanger from a piping line leading to the indoor heat exchangers.

2. A method of operating an air conditioner, the method comprising the steps of providing an outdoor heat exchanger and a plurality of indoor heat exchangers; condensing a portion of compressed refrigerant in said outdoor heat exchanger and then expanding the condensed refrigerant; introducing the remaining compressed refrigerant to some of said plurality of indoor heat exchangers for heating the associated indoor air, while condensing the refrigerant, and then expanding the condensed refrigerant; introducing both expanded refrigerant from said outdoor heat exchanger and expanded refrigerant from said sum of said indoor heat exchangers to at least one of the remaining indoor heat exchangers to be run under a cooling operation; and determining a ratio between an amount of the compressed refrigerant introduced to said sum of said indoor heat exchangers under a heating operation and an amount of the compressed refrigerant introduced to the remaining indoor heat exchangers under the cooling operation dependent upon a ratio between a magnitude of heating load of said sum of said indoor heat exchangers under the heating operation and a magnitude of a cooling load of said remaining indoor heat exchangers under the cooling operation.

* * * * *